US010696919B2

(12) United States Patent
Tompala et al.

(10) Patent No.: US 10,696,919 B2
(45) Date of Patent: Jun. 30, 2020

(54) LUBRICANT DISPERSED WITH CARBON NANOTUBES

(71) Applicant: Hindustan Petroleum Corporation Limited, Mumbai (IN)

(72) Inventors: Annaji Rajiv Kumar Tompala, Bengluru (IN); Srinivas Vadapalli, Visakhapatnam (IN); Amitabh Kumar Jain, Navi Mumbai (IN); Venkata Chalapathi Rao Peddy, Bengluru (IN); Venkateswarlu Choudary Nettem, Bengluru (IN); Sri Ganesh Gandham, Visakhapatnam (IN)

(73) Assignee: Hindustan Petroleum Corporation Limited, Mumbai (IN)

( * ) Notice: Subject to any disclaimer, the term of this patent is extended or adjusted under 35 U.S.C. 154(b) by 116 days.

(21) Appl. No.: 15/766,528

(22) PCT Filed: Jun. 30, 2016

(86) PCT No.: PCT/IN2016/050210
§ 371 (c)(1),
(2) Date: Apr. 6, 2018

(87) PCT Pub. No.: WO2017/060919
PCT Pub. Date: Apr. 13, 2017

(65) Prior Publication Data

US 2018/0282659 A1 Oct. 4, 2018

(30) Foreign Application Priority Data

Oct. 9, 2015 (IN) ..... 5431/CHE/2015

(51) Int. Cl.
*C10M 177/00* (2006.01)
*C10M 171/06* (2006.01)
*C10M 125/02* (2006.01)

(52) U.S. Cl.
CPC ..... *C10M 177/00* (2013.01); *C10M 125/02* (2013.01); *C10M 171/06* (2013.01);
(Continued)

(58) Field of Classification Search
CPC ..... C10M 125/02; C10M 171/06; C10M 177/00; C10N 2220/082; C10N 2230/02;
(Continued)

(56) References Cited

U.S. PATENT DOCUMENTS 6,187,823 B1 2/2001 Haddon et al.
2006/0068579 A1* 3/2006 Suh ..... H01L 23/562 438/612

(Continued)

OTHER PUBLICATIONS

Chen, C S et al., "Chemical Modification of multi-walled carbon nanotubes with fatty acid and their tribological properties as lubricant additive," Carbon, Elsevier, Oxford, GB, vol. 43, Jan. 1, 2005, pp. 1660-1666 (Year: 2005).*

(Continued)

*Primary Examiner* — Latosha Hines
(74) *Attorney, Agent, or Firm* — Lee & Hayes, P.C.

(57) ABSTRACT

The present subject matter describes a method for preparation of a lubricant dispersed with carbon nanotubes (CNTs) and a lubricant dispersed with the CNTs prepared thereof. The method comprises ball milling the CNTs and purifying the ball milled CNTs to remove impurities in the CNTs. The method also comprises oxidizing surfaces of the purified CNTs by adding the purified CNTs to a solution comprising at least one oxidizing acid and then refluxing the solution. The oxidized surfaces of the CNTs are modified by adding the CNTs to a solution comprising at least one fatty acid to obtain surface modified CNTs. The method also comprises dispersing the surface modified CNTs in a lubricant to obtain the lubricant dispersed with CNTs.

20 Claims, 18 Drawing Sheets

(52) U.S. Cl.
CPC .... *C10N 2220/082* (2013.01); *C10N 2230/02* (2013.01); *C10N 2230/04* (2013.01); *C10N 2230/06* (2013.01); *C10N 2230/12* (2013.01); *C10N 2230/54* (2013.01); *C10N 2240/04* (2013.01); *C10N 2240/10* (2013.01); *C10N 2240/102* (2013.01); *C10N 2240/104* (2013.01); *C10N 2260/00* (2013.01); *C10N 2260/04* (2013.01); *C10N 2270/00* (2013.01)

(58) Field of Classification Search
CPC ..... C10N 2230/04; C10N 2230/06; C10N 2230/12; C10N 2230/54; C10N 2240/04; C10N 2240/10; C10N 2240/102; C10N 2240/104; C10N 2260/00; C10N 2260/04; C10N 2270/00
See application file for complete search history.

(56) References Cited

U.S. PATENT DOCUMENTS

2011/0015106 A1* 1/2011 Habeeb ..... B82Y 30/00 508/465
2014/0231145 A1* 8/2014 Kverel ..... C09K 8/032 175/65
2016/0020466 A1* 1/2016 Ulbrich ..... H01M 4/0404 429/217
2017/0067136 A1* 3/2017 Hussein ..... C22C 14/00

OTHER PUBLICATIONS

Zhang et al. "Parameters optimization in the planetary ball milling of nanostructured tungsten carbide/cobalt powder". International Journal of Refractory Metals & Hard Materials. vol. 26. Aug. 2007. pp. 329-333. (Year: 2007).*
Chen, C S et al., "Chemical Modification of multi-walled carbon nanotubes with fatty acid and their tribological properties as lubricant additive," Carbon, Elsevier, Oxford, GB, vol. 43, Jan. 1, 2005, pp. 1660-1666.
Chen, X H et al., "Non-destructive purification of mulit-walled carbon nanotubes producted by catalyzed CVD", Materials Letters, North Holland Publishing Company, Amersterdam, NL., vo. 57, No. 3, Dec. 1, 2002, pp. 734-738.
Chuan-Sheng, Chen et al., "Chemical Modification of Carbon Nanotubes and Tribological Properties as Lubricant Additive", Acta Chimica Sinica, Jul. 28, 2004, pp. 1367-1372.
PCT Search Report for corresponding International Patent Application No. PCT/IN2016/050210 filed Jun. 30, 2016, 4 pages.

* cited by examiner 400 (a)

400 (b)

500 (a)

500 (b)

600 (a)

600 (b)

700 (a)

700 (b)

800 (a)

800 (b)

900 (a)

900 (b)

1000 (a)

1000 (b)

1100 (a)

1100 (b)

1200 (a)

1200 (b)

1300 (a)

1300 (b)

1800

LUBRICANT DISPERSED WITH CARBON NANOTUBES

TECHNICAL FIELD

The present subject matter relates, in general, to lubricants and, in particular, to lubricants dispersed with carbon nanotubes.

BACKGROUND

A lubricant is a substance introduced between surfaces in mutual contact, for example, in machines and automobiles, to reduce friction between the surfaces. In general, the functions of the lubricant are to: (a) keep surfaces of moving components separated under all loads, temperatures and speeds, thus minimizing friction and wear; (b) act as a cooling fluid removing heat produced by friction or from external sources; (c) remain adequately stable in order to ensure uniform behavior over a forecasted useful life; and (d) protect surfaces of moving mechanical components from an attack of corrosive products formed during operation. In order to meet the various functions, one or more types of additives are added into a base oil in a lubricant composition. The additives are used to improve performance characteristics of the lubricants. The additives can be, for example, antioxidants, detergents, anti-wear substances, metal deactivators, corrosion inhibitors, and rust inhibitors.

BRIEF DESCRIPTION OF DRAWINGS

The detailed description is described with reference to the accompanying figures. In the figures, the left-most digit(s) of a reference number identifies the figure in which the reference number first appears. The same numbers are used throughout the figures to reference like features and components:

FIG. 4(*b*) illustrates a graph showing wear scar diameter for petrol engine oil with different weight % of the CNTs at 40 kgf load, in accordance with an implementation of the present subject matter.

FIG. 5(*b*) illustrates a graph showing wear scar diameter for petrol engine oil with different weight % of the CNTs at 60 kgf load, in accordance with an implementation of the present subject matter.

FIG. 6(*b*) illustrates a graph showing wear scar diameter for second gear oil with different weight % of the CNTs at 40 kgf load, in accordance with an implementation of the present subject matter.

FIG. 7(*b*) illustrates a graph showing wear scar diameter for second gear oil with different weight % of the CNTs at 80 kgf load, in accordance with an implementation of the present subject matter.

FIG. 8(*b*) illustrates a graph showing seizure load for petrol engine oil with different weight % of the CNTs, in accordance with an implementation of the present subject matter.

FIG. 9(*b*) illustrates a graph showing seizure load for diesel engine oil with different weight % of the CNTs, in accordance with an implementation of the present subject matter.

FIG. 10(*b*) illustrates a graph showing seizure load for first gear oil with different weight % of the CNTs, in accordance with an implementation of the present subject matter.

FIG. 11(*b*) illustrates a graph showing seizure load for second gear oil with different weight % of the CNTs, in accordance with an implementation of the present subject matter.

FIG. 12(*b*) illustrates a graph showing weld point for first gear oil with different weight % of the CNTs, in accordance with an implementation of the present subject matter.

FIG. 13(*b*) illustrates a graph showing weld point for second gear oil with different weight % of the CNTs, in accordance with an implementation of the present subject matter.

FIG. 14(*b*) illustrates a graph showing brake thermal efficiency at 4000 RPM for petrol engine having petrol engine oil with different weight % of the surface modified CNTs, in accordance with an implementation of the present subject matter.

FIG. 15(*b*) illustrates a graph showing brake thermal efficiency at 4000 RPM for diesel engine having diesel engine oil with different weight % of the surface modified CNTs, in accordance with an implementation of the present subject matter.

DETAILED DESCRIPTION

Figure 1:
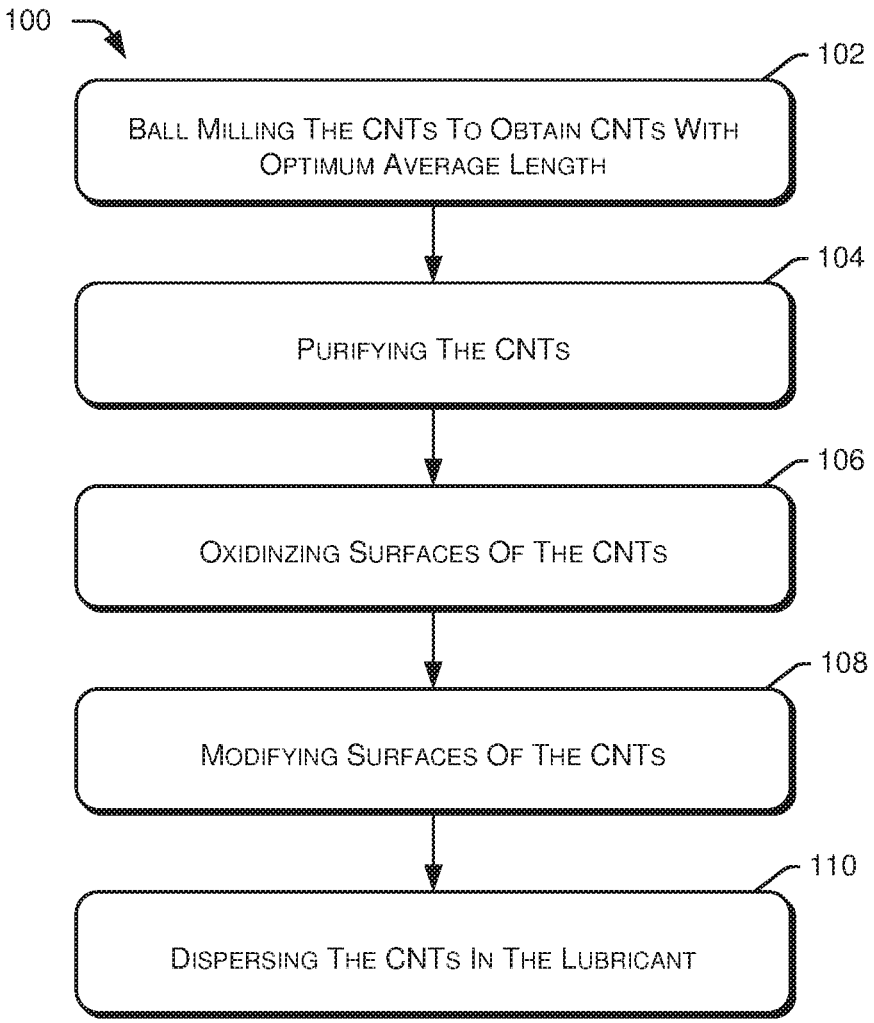
FIG. 1 illustrates a method 100 for preparation of a lubricant dispersed with the CNTs, in accordance with an implementation of the present subject matter.

The subject matter disclosed herein relates to lubricants dispersed with carbon nanotubes (CNTs). The lubricants may be used, for example, for lubrication of automobile engines and gears.

Typically, lubricants are produced by adding additives to a base oil. The base oil can be, for example, a mineral oil or a synthetic oil with polyalphaolefins. Recently, nanomaterials have been tested for use as additives in the base oils for lubricants. Nanomaterials are materials of which a single unit has a size, in at least one dimension, between 1 and 1000 nanometers.

Nanomaterial based lubricants may exhibit better tribological properties as compared to ordinary lubricants without nanoparticles. Nanomaterials are considered well suited for tribological applications since lubrication takes place at nanoscale level. For instance, certain nanomaterial molecules can form a thin coating with the thickness of just one or two molecules to separate surface asperities of the moving components of a machine. Also, nanomaterials have high surface affinity, and chemical reactivity and their small sizes enable them to penetrate into wear crevices. Thus, nanomaterials are emerging as suitable additive components for industrial lubricants, such as lubricating engine oils, greases, dry film lubricants, and forging lubricants.

Several types of nanomaterials have been studied as potential additives for lubricants, including metal oxides of silicon, titanium, nickel, tin, aluminum, and zinc; fluorides of metals, such as cerium, lanthanum, and calcium; and zinc, tin, and lead sulfides, and metals, such as nickel, zinc, tin, and silver, and non-metals like carbon nanotubes for improving performance characteristics of the lubricants. Carbon nanotube (CNT) is a type of nanomaterial that is an allotrope of carbon with a cylindrical nanostructure. CNTs have extraordinary thermal conductivity and mechanical and electrical properties. CNTs can be categorized as single walled CNTs and multi walled CNTs. The CNTs have been found to significantly improve performance characteristics, such as anti-wear, anti-friction, and extreme pressure characteristics of the lubricant.

Better lubricating properties may be obtained when the CNTs are dispersed in lubricants, i.e., when a stable suspension of the CNTs is formed in the lubricant. However, the formation of a stable suspension of CNTs in a lubricant is difficult due to a high length to diameter ratio, for example, about 750, of the CNTs. The high length to diameter ratio of the CNTs causes them to get entangled with each other which results in the formation of agglomerates in the lubricant. This leads to the settling down of the CNTs in the lubricant. Further, when the CNTs are added to the lubricant, other additives present in the lubricant may interact with surfaces of the CNTs which may also result in the formation of agglomerates. This prevents the formation of a stable suspension of the CNTs in the lubricant.

The present subject matter describes a method for preparation of a lubricant dispersed with CNTs and the lubricant prepared thereby. The method comprises ball milling the CNTs to reduce length to diameter ratio of the CNTs and then purifying the ball milled CNTs. The method further comprises oxidizing surfaces of the CNTs. The method also comprises modifying the oxidized surfaces of the CNTs to obtain surface modified CNTs. The method also comprises dispersing the surface modified CNTs in a lubricant.

The reduction of the length to diameter ratio of the CNTs by the ball milling and the surface modification of the CNTs prevent formation of agglomerates when the CNTs are added to the lubricant. This results in the formation of a stable suspension of the CNTs in the lubricant. The lubricant dispersed with the CNTs has improved performance characteristics, such as anti-wear, anti-friction, and extreme pressure characteristics when compared to lubricants without the CNTs. Thus, carbon nanotubes can be dispersed in fully formulated lubricants, i.e., lubricants comprising base oil and additives, to form stable suspensions.

These and other advantages of the present subject matter would be described in greater detail in conjunction with the following figures. It should be noted that the description and figures merely illustrate the principles of the present subject matter.

FIG. 1 illustrates a method 100 for preparation of a lubricant dispersed with the CNTs, in accordance with an implementation of the present subject matter. The lubricant may be, but is not restricted to, a SM grade lubricant, a CI 4 grade lubricant, and a GL 4 grade lubricant. The lubricant may contain about 90-99% of base oil and 1-10% of additives. The additives in the lubricant may be, for example, boron, magnesium, calcium, molybdenum, phosphorous, silicon, and zinc. In an implementation, the CNTs may be multi walled CNTs (MWCNTs) having length in a range from 1 μm to 25 μm and diameter in a range from 20 nm to 40 nm.

Typically, the CNTs have a high length to diameter ratio. In an example, the length to diameter ratio of the CNTs is about 750-1250. Reducing the length to diameter ratio of the CNTs helps to prevent formation of agglomerates in a lubricant. At block 102, the CNTs are ball milled to reduce the length to diameter ratio. A time duration for the ball milling of the CNTs may be determined based on an optimum average length of the CNTs to be obtained. In one example, the optimum average length of the CNTs may be about 2 μm to about 3 μm. For achieving the optimum average length of the CNTs, the ball milling may be performed for a time period of about 16 hours. In an example, the ball milled CNTs may have length in a range from about 1 μm to about 5 μm and an average length between 2-3 μm. As a result of the ball milling, the CNTs may have a length to diameter ratio in a range of from about 50 to 250. The ball milling of the CNTs also makes them short and open-ended. In one implementation, the ball milling of the CNTs may be performed using a planetary ball mill with tungsten carbide coated vials and tungsten carbide balls. The tungsten carbide coated vials may have a volume of 25 ml. The tungsten carbide balls may comprise two different types of balls in which first type of balls has a diameter of 12 mm and second type of balls has a diameter of 6 mm. The two different types of balls together produce a high amount of energy thereby ensuring better ball milling of the CNTs. The ball milling may be performed for a time period in a range from about 8 hours to about 16 hours. Although the ball milling is explained with respect to a planetary ball mill, however, it will be appreciated that any other type of ball mill may also be used.

The CNTs may contain impurities for example, metal particles and amorphous carbon. Further, the ball milling of the CNTs can cause the formation of impurities, such as ash and soot. The presence of the impurities may result in the formation of agglomerates upon dispersion in the lubricant and can also impact the tribological properties of the CNTs. At block 104, the ball milled CNTs are purified to remove the impurities in the CNTs.

In an implementation, the purifying of the ball milled CNTs comprises heating of the CNTs in the presence of air. The heating of the CNTs in the presence of air removes the amorphous carbon present in the CNTs. The heating of the CNTs may be performed at a temperature of about 600° C. for a time period of about 1 hour.

In an implementation, the purifying of the ball milled CNTs further comprises purifying the CNTs using hydrochloric acid. The purification of the CNTs using hydrochloric acid removes other impurities present in the CNTs, such as metal particles and ash. For purification using hydrochloric acid, the CNTs may be added to a 6 M hydrochloric acid solution. The hydrochloric acid solution may then be refluxed at boil. In an example, about 4 grams of the CNTs are added to about 600 ml of the 6 M hydrochloric acid solution and the solution is then refluxed at boil for a time period of about 4 hours.

At block 106, surfaces of the CNTs are oxidized. The oxidation of the surfaces of the CNTs results in attachment of one or more hydrophilic functional groups to the surfaces of the CNTs. The one or more hydrophilic functional groups may include, but are not restricted to, a hydroxyl functional group and a carboxyl functional group. The attachment of the one or more hydrophilic functional groups to the surfaces of the CNTs enables easier modification of the surfaces of the CNTs which is explained in greater detail with respect to block 108. The surfaces of the CNTs are oxidized by adding the CNTs to a solution comprising at least one oxidizing acid and then refluxing the solution. The at least one oxidizing acid may be, but is not restricted to, nitric acid and sulphuric acid. The solution comprising at least one oxidizing acid may be, but is not restricted to, a hydrogen peroxide-sulphuric acid solution and a nitric acid-sulphuric acid solution. The solution comprising at least one oxidizing acid may contain nitric acid and sulphuric acid in a ratio of 1:3 by volume. In an implementation, about 3 g of the CNTs are added to about 600 ml of the solution comprising at least one oxidizing acid and then the solution is refluxed at a temperature of about 120° C.

Even though the CNTs are ball milled to prevent the formation of agglomerates in the lubricant, however, with the passage of time, the CNTs may form agglomerates due to interaction of other additives in the lubricant with the surfaces of the CNTs. To prevent this, at block 108, the oxidized surfaces of the CNTs are modified to obtain surface modified CNTs. The modification of the oxidized surfaces of the CNTs comprises adding the CNTs to a solution comprising at least one fatty acid. The at least one fatty acid may include, but is not restricted to, stearic acid, lauric acid, and palmitic acid. The surface modification by addition of the CNTs to the solution comprising at least one fatty acid is explained in greater detail with reference to FIG. 2. When the CNTs are added to the solution comprising at least one fatty acid, the oxidized surfaces of the CNTs react with the at least one fatty acid to form a functional group with a long chain. The functional group may include, but is not restricted to, an ester functional group. The presence of the long chained functional group on the surfaces of the CNTs prevents the CNTs from forming agglomerates in the lubricant when they interact with the additives in the lubricant. Thus, the CNTs form a stable suspension when they are added to the lubricant.

At block 110, the surface modified CNTs are dispersed in the lubricant. In an implementation, the surface modified CNTs may be dispersed in the lubricant using a sonication process. The sonication process uniformly disperses the surface modified CNTs in the lubricant and may be carried out with an ultrasonic probe sonicator. The sonication process may comprise sonication under a pulse mode and sonication under a continuous mode. In the sonication under a pulse mode, the sonication may be performed using a 0.5 sec pulse at 50% amplitude for a time period of 10 minutes. In the sonication under a continuous mode, the sonication may be performed at 50% amplitude for a time period of 30 minutes. In an implementation, about 0.05 weight % to 0.1 weight % of the surface modified CNTs are added to the lubricant before dispersion using the sonication process.

Figure 2:
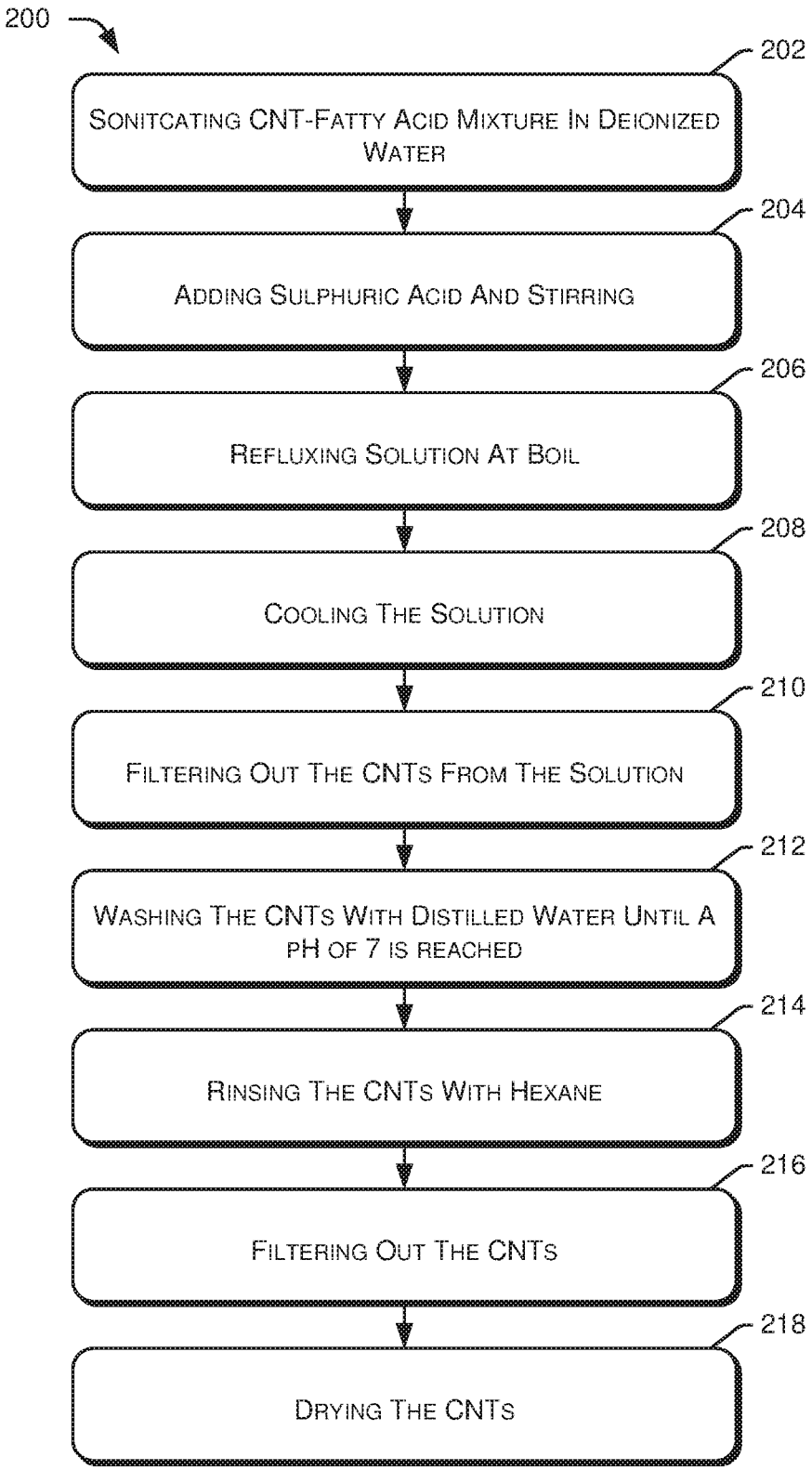
FIG. 2 illustrates a method 200 for surface modification by adding the CNTs to a solution comprising at least one fatty acid, in accordance with an implementation of the present subject matter.

FIG. 2 illustrates a method 200 for surface modification by adding the CNTs to a solution comprising at least one fatty acid, in accordance with an implementation of the present subject matter. At block 202, a CNT-fatty acid solution mixture is sonicated to form a suspension. In an example, the CNT-fatty acid solution mixture may have the CNTs and the fatty acid in a weight ratio of about 1:4. The solution comprising at least one fatty acid may be a sulphuric acid solution of molarity in a range from 2 M to 4 M. The sonication may be performed in a water bath sonicator at a frequency of about 20 kHz for a time period of about 45 minutes. At block 204, sulphuric acid is added to the suspension. The sulphuric acid may be added to the suspension until the solution reaches a molarity of 4M of sulphuric acid. At block 206, the solution is refluxed at boil. In an example, the refluxing may be performed at a temperature of about 100° C. for a time period in a range from about 2 hours to about 3 hours. The refluxing of the solution at boil helps the fatty acids to react with the hydroxyl functional groups on the surfaces of the CNTs and converts the hydroxyl functional groups on the surfaces of the CNTs into ester functional groups. At block 208, the solution is cooled at ambient temperature. At block 210, the CNTs are filtered from the solution. The filtering may be performed using a membrane filter. At block 212, the filtered CNTs are washed using distilled water to remove acidic content. At block 214, the CNTs are rinsed in a solvent to remove excess fatty acid from the CNTs. The solvent may include, but is not restricted to, like hexane, isooctane, and n-heptane. At block 216, the CNTs are filtered. Finally, at block 218, the CNTs are dried. The CNTs may be dried at a temperature of about 80° C.

In an implementation, the CNTs may be filtered from the solution in which it is present, for example, the hydrochloric acid solution and the solution comprising at least one oxidizing acid. The CNTs in the solution may be acidic in nature due to presence of one or more acids in the solution. Therefore, the solution may be diluted with distilled water. The CNTs may then be filtered from the diluted solution. Thereafter, the filtered CNTs may be washed with distilled water until the filtered CNTs reach a pH of about 7, thus, removing the acidic content from the CNTs. The CNTs may then be filtered from the distilled water. The filtering may be performed using a filter membrane system and a vacuum pump. Finally, the CNTs may be dried. The CNTs are dried in a vacuum oven at a temperature of about 50° C. for example for about 6-12 hours.

EXAMPLES

The following general methods for determining viscosity index, total acid number, total base number, and corrosiveness of lubricant, evaluation of anti-wear, anti-friction, and extreme pressure properties of the lubricant, analysis of hydroxyl and carboxyl functional groups in the CNTs, and analysis of average length of the CNTs are used in the Examples.

The term "surface modified CNTs" as used in the examples refers to surface modified multi walled CNTs which were ball milled for a time period of about 16 hours.

The term "petrol engine oil" as used in the examples refers to a petrol engine oil of SM grade having a viscosity grade 20W-40.

The term "diesel engine oil" as used in the examples refers to a diesel engine oil of CM grade having the viscosity grade 15W-40.

The term "first gear oil" as used in the examples refers to a gear oil of GL 4 grade having the viscosity grade 80W-90.

The term "second gear oil" as used in the examples refers to a gear oil of GL 4 grade having an extreme pressure (EP) grade EP 140.

The term "viscosity index" as used in the examples refers to change in viscosity of a lubricant with change in temperature. The lower the viscosity index, the greater is the change of viscosity of the lubricant with temperature. Thus, the higher the viscosity index, the better is the quality of the lubricant. A viscosity index value greater than 90 is preferred for the lubricant.

The term "American Society for Testing and Materials (ASTM) D 445" as used in the examples refers to a test method that specifies a procedure for determination of kinematic viscosity of the lubricant by measuring the time for a volume of liquid to flow under gravity through a calibrated glass capillary viscometer.

The term "total acid number" (TAN) as used in the examples refers to a measure of weak organic and strong inorganic acids present in the lubricant. The TAN is measured as per test method ASTM D 664. The TAN is the amount of potassium hydroxide in milligrams required to neutralize the acids in one gram of the lubricant. The TAN value indicates potential corrosiveness of the lubricant. A TAN value lesser than 3 indicates that the lubricant is stable.

The term "total base number" (TBN) as used in the examples refers to effectiveness of the lubricant in controlling acid formation during combustion process. The higher the TBN, the more effective the lubricant is in suspending wear-causing contaminants and reducing the corrosive effects of acids over an extended period of time.

The term "ASTM D 2896" as used in the examples refers to a test method for determination of the TBN of the lubricant by potentiometric titration with perchloric acid in glacial acetic acid.

The term "ASTM copper strip corrosion standard" as used in the examples refers to a standard defined by test method ASTM D 130 and is used for representing corrosion protection of the lubricant. The standard has classification numbers from 1 to 4 for various color and tarnish levels of a copper strip immersed in the lubricant. A classification number of 1a indicates excellent corrosion protection, 1b indicates good corrosion protection, and 1c indicates sufficient corrosion protection.

The term "copper strip corrosion test" as used in the examples refers to a test used for determining the classification number of the lubricant. The test involves immersion of a polished copper strip in the lubricant at elevated temperature for a period of time and testing the color and tarnish levels of the copper strip.

The term "four-ball wear test machine" as used in the examples refers to a machine used for testing various performance characteristics of the lubricant. The machine comprises a ball pot in which three balls are clamped together and covered with the lubricant. A fourth ball is pressed against a cavity formed by the three clamped balls and rotated.

The term "wear scar diameter" as used in the examples refers to diameter of wear scars on three stationary balls which are clamped together on the four-ball wear test machine. The larger the wear scar diameter, the poorer is the lubricating ability of the lubricant.

The term "ASTM D 4172" as used in the examples refers to a test method for evaluation of the anti-wear properties of the lubricants in sliding contact by means of the four-ball wear test machine.

The term "seizure load" as used in the examples refers to a load at which a sudden increase in coefficient of friction value occurs. The higher the seizure load, the better is the anti-friction property of the lubricant.

The term "friction test" as used in the examples refers to a test performed as per test method ASTM D 5183 for determining the seizure load and coefficient of friction of the lubricant. According to the friction test, initially, a wear test, also known as wear in, is conducted as per ASTM D 4172 under the following conditions:

Temperature: about 75° C.
Speed: about 600 RPM
Load: about 392 N (40 kgf)
Duration: about 1 hour.

After the wear in, the lubricant used in the wear in is discarded and the balls of the four-ball wear test machine are cleaned. A fresh sample about 10 ml of the lubricant is added to the ball pot with the worn-in balls in place. The temperature of the lubricant is regulated at about 75° C. and the fourth ball is rotated at a speed of about 600 RPM at an initial load of about 98.1 N for duration of about 10 minutes. The load is increased by about 98.1 N at the end of each successive 10 minute interval up to a point where a frictional torque—time graph indicates a sharp rise in the frictional torque. The sharp rise in the frictional torque is also known as incipient seizure. The coefficient of friction is measured based on the frictional torque from the initial load to the seizure load.

The term "ASTM D 2783" as used in the examples refers to a test method for determination of load-carrying properties of the lubricant. The following two determinations are made using ASTM D 2783: 1. Load-wear index and 2. Weld load.

The term "load-wear index" as used in the examples refers to an extreme pressure (EP) property of the lubricant calculated using the four-ball wear test machine. An initial load is applied to the three stationary balls using the fourth ball and the load is gradually increased at regular intervals. A series of 10 such loads are applied to the three stationary balls until the balls weld with each other. Scar diameters are calculated at each applied load and a corrected load is calculated as follows:

$$\text{Corrected load}=LD_h/X;$$

where L is the applied load in kgf, $D_h$ is hertz scar diameter in mm, and X is average scar diameter in mm.

Hertz scar diameter is the average diameter, in mm, of an indentation caused by deformation of the balls under a static load P before application of the load. It may be calculated from the equation $D_h=8.73\times10^{-3}X(P)^{1/3}$. The load-wear index is then calculated as average of the corrected loads for the 10 applied loads.

The term "weld point" as used in the examples refers to a load at which the balls tested on the four-ball wear test machine weld with each other.

The term "brake thermal efficiency" as used in the examples refers to a brake power of a heat engine as a function of thermal input from a fuel. It is used to evaluate how well the heat engine converts the thermal input from the fuel to mechanical energy.

The term "Morse test" as used in the examples refers to a test conducted to determine power developed in each cylinder in a multi-cylinder IC engine. According to Morse test, first, brake power developed by all cylinders of the engine together is determined experimentally. Then, power supply to spark plug of an individual cylinder is cut off and brake power developed by the engine with remaining cylinders is determined experimentally. The brake power developed by the engine with remaining cylinders is subtracted from the power developed by all cylinders to determine indicated power developed by the individual cylinder.

The term "endurance test" as used in the examples refers to a test performed for a prolonged period of time to determine anti-wear and anti-friction characteristics of the lubricant.

The term "cylinder liner" as used in the examples refers to a lining in cylinder of the engine in which a piston in the cylinder reciprocates and produces power.

Figure 3:
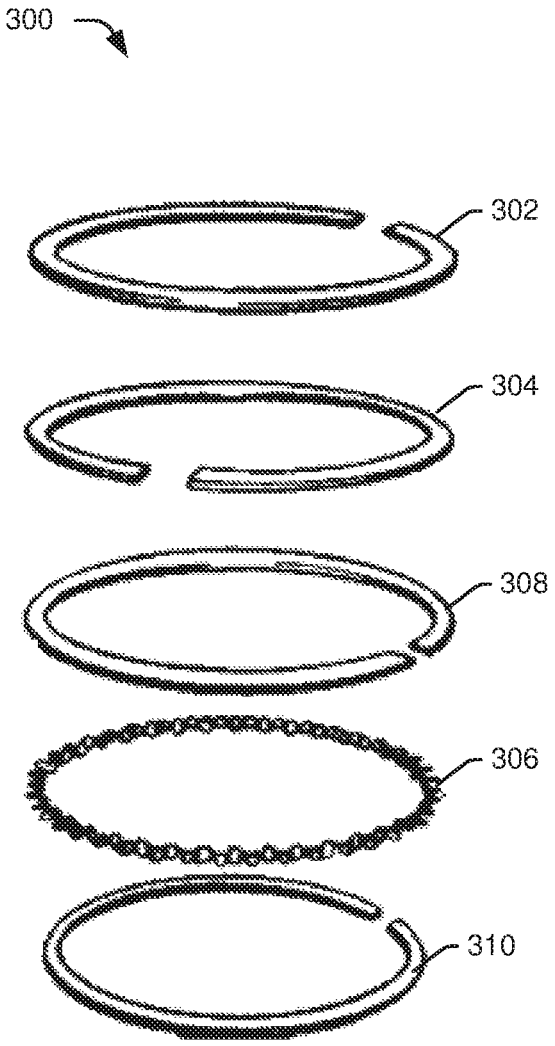
FIG. 3 illustrates oil piston rings 300 of a petrol engine used for performing endurance test, in accordance with an implementation of the present subject matter.

The term "oil piston rings" as used in the examples refers to rings placed around the piston to prevent leakage of the lubricant into the cylinder. FIG. 3 illustrates the oil piston rings. The oil piston rings may be 4 to 6 in number and may include a top compression ring 302, a second compression ring 304, an expander 306, a first oil ring 308, and a second oil ring 310.

The term "top dead center (TDC)" as used in the examples refers to the furthest point of the piston's travel. In other words, the TDC of the engine is a point at which the piston changes from an upward stroke to a downward stroke.

The term "gudgeon pin" as used in the examples refers to a pin used to connect the piston to a connecting rod of the engine.

The term "bench test" as used in the examples refers to a test for testing performance of the engine under different loads and different speeds to measure efficiencies of the engine.

Example 1

Viscosity Tests

In this example, the viscosity index is calculated for different lubricants having different weight % of the surface modified CNTs as per ASTM D 445 by measuring viscosity of the lubricants at 40° C. and 100° C. The viscosity and viscosity index were measured for the petrol engine oil and the diesel engine oil without the CNTs, with 0.05 weight % surface modified CNTs, and with 0.1 weight % surface modified CNTs at temperatures of 40° C. and 100° C. The results of the example are tabulated in tables 1 and 2 below.

TABLE 1

Viscosity index of the petrol engine oil with different weight percentages of the surface modified CNTs

| Weight % of surface modified CNTs in the petrol engine oil | Viscosity at 40° C. | Viscosity at 100° C. | Viscosity index |
|---|---|---|---|
| 0 | 137.18 | 15.68 | >110 |
| 0.05 | 139.24 | 15.35 | >110 |
| 0.1 | 139.1 | 15.25 | >110 |

TABLE 2

Viscosity index of the diesel engine oil with different weight percentages of the surface modified CNTs

| Weight % of surface modified CNTs in the diesel engine oil | Viscosity at 40° C. | Viscosity at 100° C. | Viscosity index |
|---|---|---|---|
| 0 | 137.18 | 15.68 | >110 |
| 0.05 | 133.66 | 14.97 | >110 |
| 0.1 | 133.02 | 15.01 | >110 |

As shown in tables 1 and 2, the lubricant with the surface modified CNTs has a high value of the viscosity and the viscosity index.

Example 2

Total Acid Number Tests

In this example, TAN of lubricants without CNTs and TAN of lubricants with pristine CNTs, i.e., CNTs without ball milling and surface modification, is compared with TAN of lubricants with the surface modified CNTs. The TAN was measured for the petrol engine oil and the diesel engine oil without the CNTs, with 0.05 weight % pristine CNTs, and with 0.1 weight % pristine CNTs. The TAN was also measured for the petrol engine oil and the diesel engine oil with 0.05 weight % surface modified CNTs, and with 0.1 weight % surface modified CNTs. The results of the example are tabulated in tables 3, 4, 5, and 6 below.

TABLE 3

TAN of the petrol engine oil with different weight percentages of the pristine CNTs

| Weight % of pristine CNTs in the petrol engine oil | TAN |
|---|---|
| 0 | <2 |
| 0.05 | <2 |
| 0.1 | <2 |

TABLE 4

| TAN of the diesel engine oil with different weight percentages of the pristine CNTs | |
|---|---|
| Weight % of pristine CNTs in the diesel engine oil | TAN |
| 0 | <2.2 |
| 0.05 | <2.2 |
| 0.1 | <2.2 |

TABLE 5

| TAN of the petrol engine oil with different weight percentages of the surface modified CNTs | |
|---|---|
| Weight % of surface modified CNTs in the petrol engine oil | TAN |
| 0 | <2 |
| 0.05 | <2 |
| 0.1 | <2 |

TABLE 6

| TAN of the diesel engine oil with different weight percentages of the surface modified CNTs | |
|---|---|
| Weight % of surface modified CNTs in the diesel engine oil | TAN |
| 0 | <2.2 |
| 0.05 | <2.2 |
| 0.1 | <2.2 |

As shown in tables 3, 4, 5, and 6, the petrol and the diesel engine oils with the CNTs have about the same value of TAN as the petrol and the diesel engine oil without the CNTs.

Example 3

Total Base Number Tests

In this example, TBN of lubricants without CNTs and TBN of lubricants with the pristine CNTs are compared with TBN of lubricants with the surface modified CNTs. The TBN was measured for the petrol engine oil without the CNTs, with 0.1 weight % pristine CNTs, and with 0.1 weight % surface modified CNTs as per ASTM D 2896. The TBN was also measured for the diesel engine oil without the CNTs, with 0.1 weight % pristine CNTs, and with 0.1 weight % surface modified CNTs using ASTM D 2896. The results of the example are tabulated in tables 7 and 8 below.

TABLE 7

| TBN of the petrol engine oil with different weight percentage of different types of CNTs | |
|---|---|
| Weight % and type of CNTs in the petrol engine oil | TBN |
| 0% | >10 |
| 0.1% pristine | >10 |
| 0.1% surface modified | >10 |

TABLE 8

| TBN of the diesel engine oil with different weight percentage of different types CNTs | |
|---|---|
| Weight % and type of CNTs in the diesel engine oil | TBN |
| 0% | >6 |
| 0.1% pristine | >6 |
| 0.1% surface modified | >6 |

As shown in tables 7 and 8, the petrol and the diesel engine oils with the CNTs have about the same value of TBN as the petrol and the diesel engine oils without the CNTs.

Example 4

Copper Strip Corrosion Test

In this example, the classification number of a lubricant without the surface modified CNTs is compared with the classification number of a lubricant with the surface modified CNTs. Different copper strips were immersed in about 30 ml of the petrol engine oil without the surface modified CNTs and in about 30 ml of the petrol engine oil with the surface modified CNTs at about 100° C. After about 3 hours, the copper strips were removed, washed, and their color and tarnish level were compared against the ASTM Copper Strip Corrosion Standard. The results of the example are tabulated in table 9 below.

TABLE 9

| Classification numbers for the petrol engine oil without surface modified CNTs and with surface modified CNTs | |
|---|---|
| Sample | Classification Number |
| Petrol engine oil without surface modified CNTs | 1a |
| Petrol engine oil with surface modified CNTs | 1a |

As shown in table 9, the petrol engine oil with the surface modified CNTs have about the similar corrosion protection properties as the petrol engine oil without the surface modified CNTs.

Example 5

Wear Test for Petrol and Diesel Engine Oils

In this example, wear scar diameter (WSD) of the three stationary balls of the four-ball wear test machine covered with the petrol and diesel engine oils were measured. The wear test was conducted for the diesel engine oil without the CNTs, with 0.05 weight % pristine CNTs, with 0.1 weight % pristine CNTs, with 0.05 weight % surface modified CNTs, and with 0.1 weight % surface modified CNTs at 40 kgf and 60 kgf loads. The wear test was also conducted for the petrol engine oil without the CNTs, with 0.05 weight % pristine CNTs, with 0.1 weight % pristine CNTs, with 0.05 weight % surface modified CNTs, and with 0.1 weight % surface modified CNTs at 40 kgf and 60 kgf loads. The WSDs were measured using a metallurgical microscope. The results of the example are tabulated in tables 10, 11, 12, and 13 below and graphically illustrated in FIGS. 4(*a*), 4(*b*), 5(*a*), and 5(*b*).

TABLE 10

| WSD for the diesel engine oil with different weight % of the CNTs at 40 kgf load | | |
|---|---|---|
| CNT Type | Weight % of CNTs | WSD (in μm) |
| None | 0 | 408.07 |
| Pristine | 0.05 | 435.33 |
| Pristine | 0.1 | 448.21 |
| Surface Modified | 0.05 | 388.86 |
| Surface Modified | 0.1 | 396.13 |

TABLE 11

| WSD for the petrol engine oil with different weight % of the CNTs at 40 kgf load | | |
|---|---|---|
| CNT Type | Weight % of CNTs | WSD (in μm) |
| None | 0 | 405.83 |
| Pristine | 0.05 | 381.44 |
| Pristine | 0.1 | 390.3 |
| Surface Modified | 0.05 | 375.91 |
| Surface Modified | 0.1 | 395.32 |

TABLE 12

| WSD for the diesel engine oil with different weight % of the CNTs at 60 kgf load | | |
|---|---|---|
| CNT Type | Weight % of CNTs | WSD (in μm) |
| None | 0 | 465.07 |
| Pristine | 0.05 | 452.05 |
| Pristine | 0.1 | 457.6 |
| Surface Modified | 0.05 | 435.33 |
| Surface Modified | 0.1 | 448.21 |

TABLE 13

| WSD for the petrol engine oil with different weight % of the CNTs at 60 kgf load | | |
|---|---|---|
| CNT Type | Weight % of CNTs | WSD (in μm) |
| None | 0 | 483.41 |
| Pristine | 0.05 | 500.31 |
| Pristine | 0.1 | 550.32 |
| Surface Modified | 0.05 | 468.05 |
| Surface Modified | 0.1 | 484.9 |

Figure 4A:
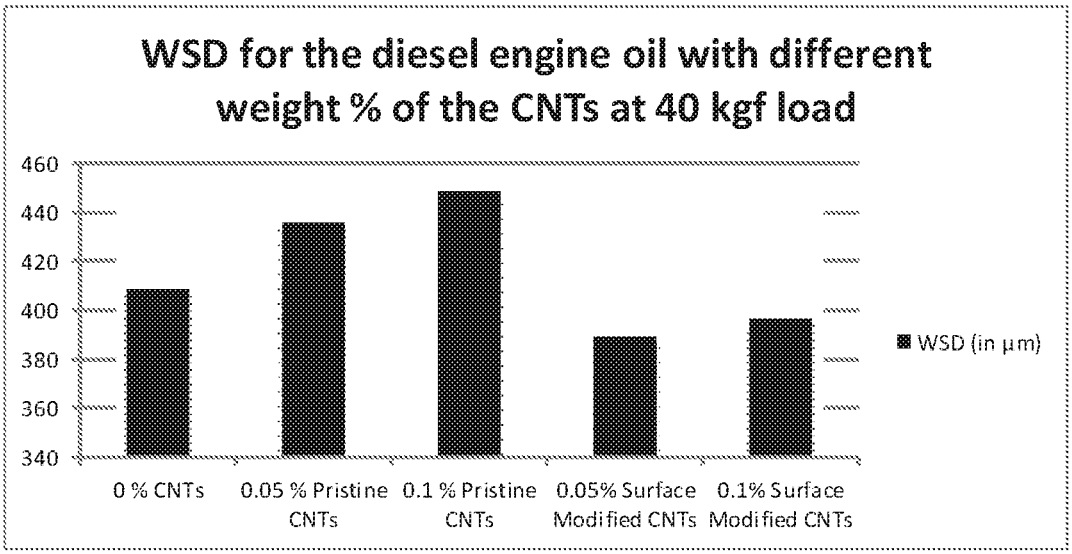
FIG. 4(*a*) illustrates a graph showing wear scar diameter for diesel engine oil with different weight % of the CNTs at 40 kgf load, in accordance with an implementation of the present subject matter.
Figure 4B:
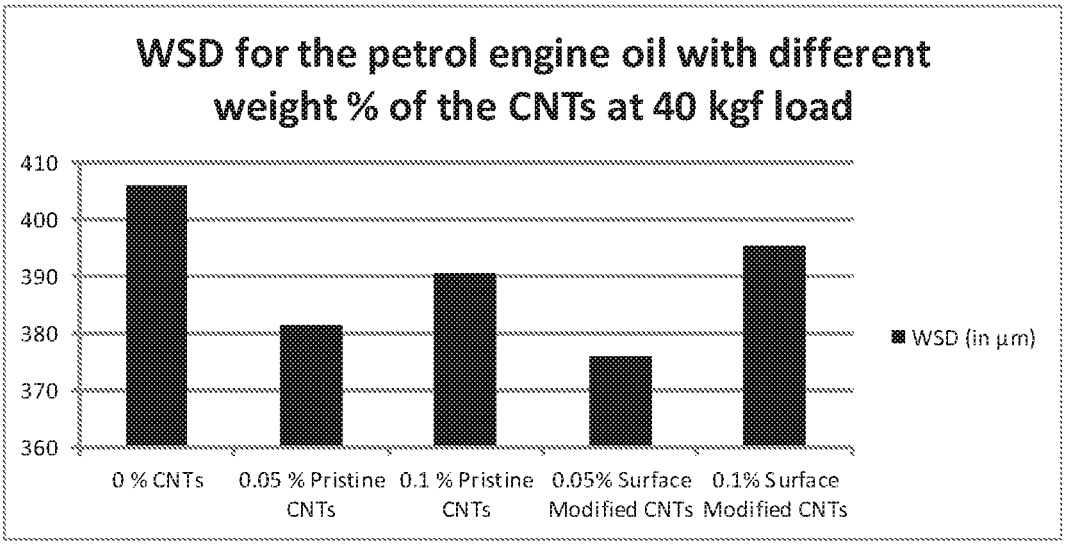
Figure 5A:
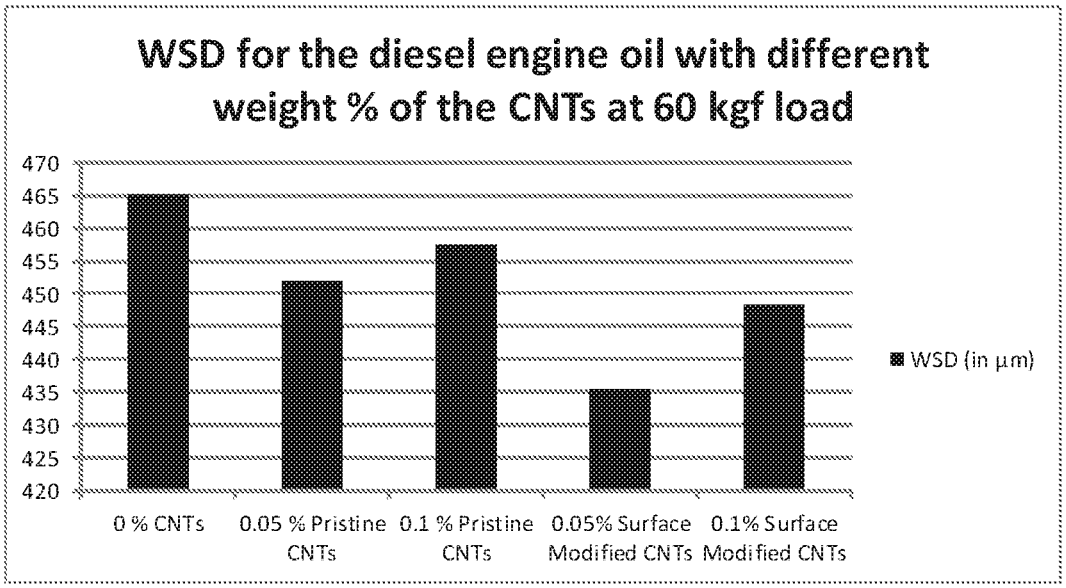
FIG. 5(*a*) illustrates a graph showing wear scar diameter for diesel engine oil with different weight % of the CNTs at 60 kgf load, in accordance with an implementation of the present subject matter.
Figure 5B:
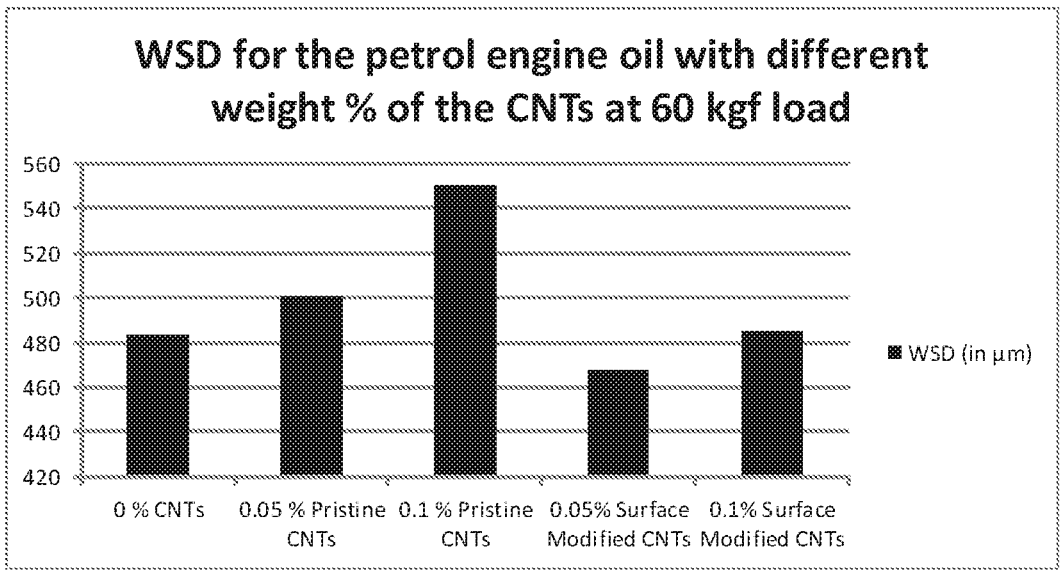

As shown in tables 10, 11, 12, and 13 and FIGS. 4(*a*), 4(*b*), 5(*a*), and 5(*b*) the petrol and diesel engine oils show a significant improvement in anti-wear characteristics due to the addition of 0.05 weight % of the surface modified CNTs.

Example 6

Wear Test for First and Second Gear Oils

In this example, wear scar diameter (WSD) of the three stationary balls covered with the first and second gear oil were measured. The wear test was conducted for the first gear oil without the CNTs, with 0.05 weight % pristine CNTs, with 0.1 weight % pristine CNTs, with 0.05 weight % surface modified CNTs, and with 0.1 weight % surface modified CNTs at 40 kgf and 80 kgf loads. The wear test was also conducted for the second gear oil without the CNTs, with 0.05 weight % pristine CNTs, with 0.1 weight % pristine CNTs, with 0.05 weight % surface modified CNTs, and with 0.1 weight % surface modified CNTs at 40 kgf and 80 kgf loads. The WSDs were measured using a metallurgical microscope. The results of the example are tabulated in tables 14, 15, 16, and 17 below and graphically illustrated in FIGS. 6(*a*), 6(*b*), 7(*a*), and 7(*b*).

TABLE 14

| WSD for the first gear oil with different weight % of the CNTs at 40 kgf load | | |
|---|---|---|
| CNT Type | Weight % of CNTs | WSD (in μm) |
| None | 0 | 370.78 |
| Pristine | 0.05 | 374.42 |
| Pristine | 0.1 | 378.08 |
| Surface Modified | 0.05 | 355.41 |
| Surface Modified | 0.1 | 367.48 |

TABLE 15

| WSD for the second gear oil with different weight % of the CNTs at 40 kgf load | | |
|---|---|---|
| CNT Type | Weight % of CNTs | WSD (in μm) |
| None | 0 | 370.78 |
| Pristine | 0.05 | 341.12 |
| Pristine | 0.1 | 338.89 |
| Surface Modified | 0.05 | 344.1 |
| Surface Modified | 0.1 | 346.84 |

TABLE 16

| WSD for the first gear oil with different weight % of the CNTs at 80 kgf load | | |
|---|---|---|
| CNT Type | Weight % of CNTs | WSD (in μm) |
| None | 0 | 865.7 |
| Pristine | 0.05 | 825.34 |
| Pristine | 0.1 | 901.25 |
| Surface Modified | 0.05 | 682.24 |
| Surface Modified | 0.1 | 783.57 |

TABLE 17

| WSD for the second gear oil with different weight % of the CNTs at 80 kgf load | | |
|---|---|---|
| CNT Type | Weight % of CNTs | WSD (in μm) |
| None | 0 | 758.32 |
| Pristine | 0.05 | 489.32 |
| Pristine | 0.1 | 683.12 |
| Surface Modified | 0.05 | 433.92 |
| Surface Modified | 0.1 | 544.97 |

Figure 6A:
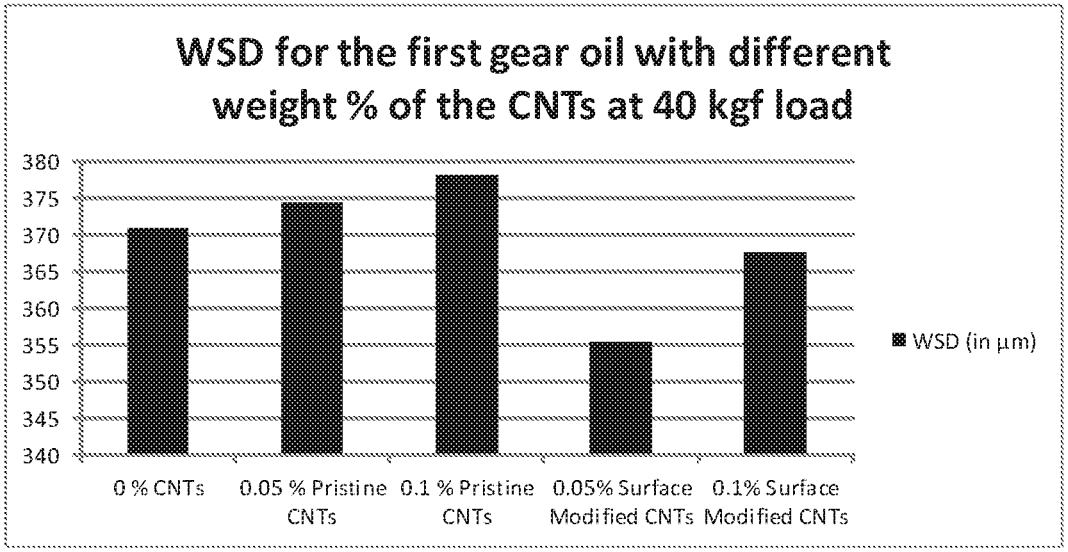
FIG. 6(*a*) illustrates a graph showing wear scar diameter for first gear oil with different weight % of the CNTs at 40 kgf load, in accordance with an implementation of the present subject matter.
Figure 6B:
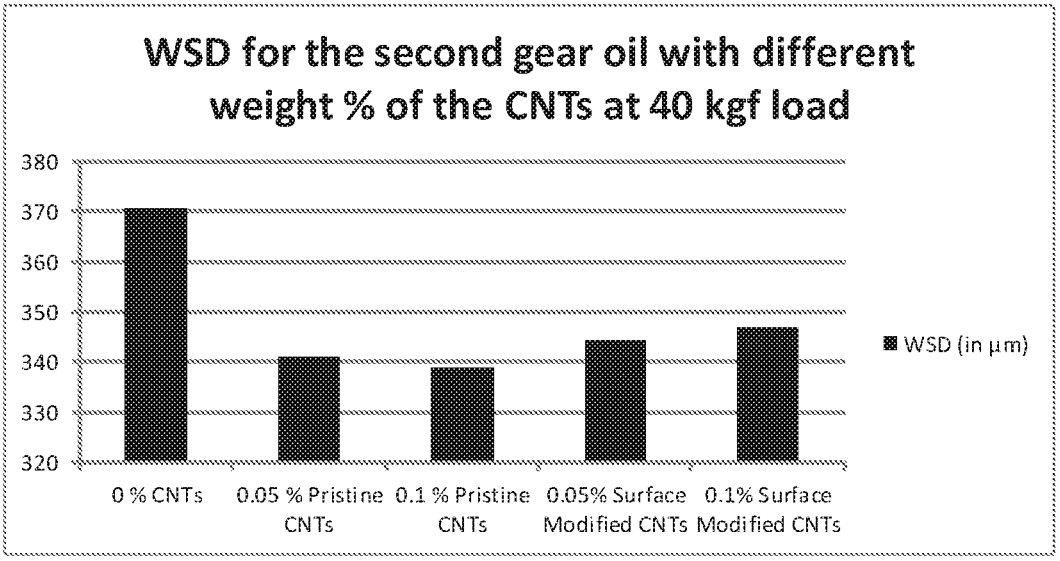
Figure 7A:
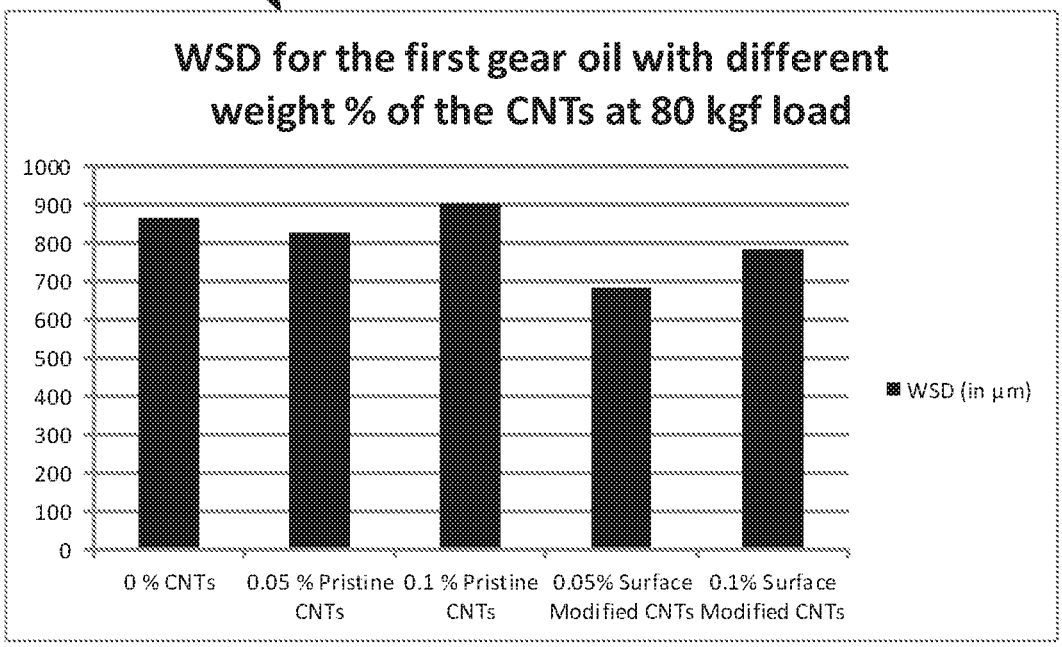
FIG. 7(*a*) illustrates a graph showing wear scar diameter for first gear oil with different weight % of the CNTs at 80 kgf load, in accordance with an implementation of the present subject matter.
Figure 7B:
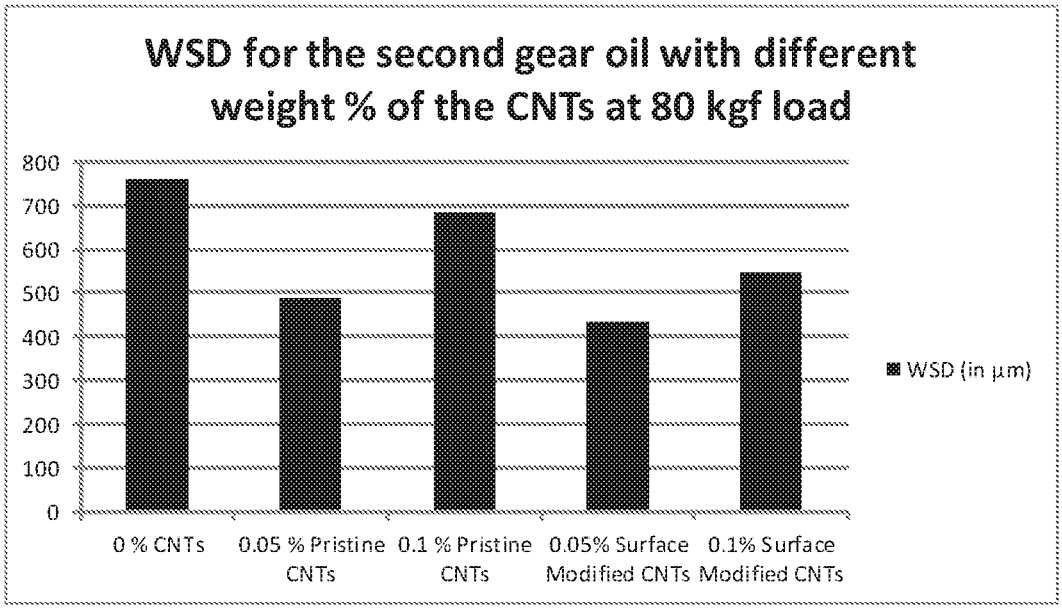

As shown in tables 14, 15, 16, and 17 and FIGS. 6(*a*), 6(*b*), 7(*a*), and 7(*b*), the first and second gear oils show a significant improvement in anti-wear characteristics due to the addition of 0.05 weight % of the surface modified CNTs.

Example 7

Friction Test for Lubricants

In this example, coefficient of friction and seizure load were measured for the petrol engine oil, the diesel engine oil, and the first and the second gear oils as per ASTM D 5183. The wear test was conducted for the oils without the CNTs, with 0.05 weight % pristine CNTs, with 0.1 weight % pristine CNTs, with 0.2 weight % pristine CNTs, with 0.05 weight % surface modified CNTs, with 0.1 weight % surface modified CNTs, and with 0.2 weight % surface modified CNTs. The results of the example are tabulated in tables 18-25 below and graphically illustrated in FIGS. 8(*a*), 8(*b*), 9(*a*), 9(*b*), 10(*a*), 10(*b*), 11(*a*), and 11(*b*).

TABLE 18

Coefficient of friction for the petrol engine oil with different weight % of the CNTs

| CNT Type | Weight % of CNTs | Coefficient of friction |
|---|---|---|
| None | 0 | 0.101 |
| Pristine | 0.05 | 0.089 |
| Pristine | 0.1 | 0.092 |
| Pristine | 0.2 | 0.1183 |
| Surface Modified | 0.05 | 0.082 |
| Surface Modified | 0.1 | 0.093 |
| Surface Modified | 0.2 | 0.105 |

TABLE 19

Seizure load for the petrol engine oil with different weight % of the CNTs

| CNT Type | Weight % of CNTs | Seizure Load (kgf) |
|---|---|---|
| None | 0 | 130 |
| Pristine | 0.05 | 120 |
| Pristine | 0.1 | 120 |
| Pristine | 0.2 | 100 |
| Surface Modified | 0.05 | 140 |
| Surface Modified | 0.1 | 140 |
| Surface Modified | 0.2 | 110 |

TABLE 20

Coefficient of friction for the diesel engine oil with different weight % of the CNTs

| CNT Type | Weight % of CNTs | Coefficient of friction |
|---|---|---|
| None | 0 | 0.081 |
| Pristine | 0.05 | 0.1 |
| Pristine | 0.1 | 0.106 |
| Pristine | 0.2 | 0.113 |
| Surface Modified | 0.05 | 0.0725 |
| Surface Modified | 0.1 | 0.0763 |
| Surface Modified | 0.2 | 0.098 |

TABLE 21

Seizure load for the diesel engine oil with different weight % of the CNTs

| CNT Type | Weight % of CNTs | Seizure Load (kgf) |
|---|---|---|
| None | 0 | 110 |
| Pristine | 0.05 | 120 |
| Pristine | 0.1 | 130 |
| Pristine | 0.2 | 110 |
| Surface Modified | 0.05 | 140 |
| Surface Modified | 0.1 | 110 |
| Surface Modified | 0.2 | 110 |

TABLE 22

Coefficient of friction for the first gear oil with different weight % of the CNTs

| CNT Type | Weight % of CNTs | Coefficient of friction |
|---|---|---|
| None | 0 | 0.083 |
| Pristine | 0.05 | 0.1 |
| Pristine | 0.1 | 0.0978 |
| Pristine | 0.2 | 0.1053 |
| Surface Modified | 0.05 | 0.0778 |
| Surface Modified | 0.1 | 0.081 |
| Surface Modified | 0.2 | 0.089 |

TABLE 23

Seizure load for the first gear oil with different weight % of the CNTs

| CNT Type | Weight % of CNTs | Seizure Load (kgf) |
|---|---|---|
| None | 0 | 140 |
| Pristine | 0.05 | 140 |
| Pristine | 0.1 | 130 |
| Pristine | 0.2 | 120 |
| Surface Modified | 0.05 | 150 |
| Surface Modified | 0.1 | 150 |
| Surface Modified | 0.2 | 130 |

TABLE 24

Coefficient of friction for the second gear oil with different weight % of the CNTs

| CNT Type | Weight % of CNTs | Coefficient of friction |
|---|---|---|
| None | 0 | 0.088 |
| Pristine | 0.05 | 0.0901 |
| Pristine | 0.1 | 0.0995 |
| Pristine | 0.2 | 0.1121 |
| Surface Modified | 0.05 | 0.0783 |
| Surface Modified | 0.1 | 0.0798 |
| Surface Modified | 0.2 | 0.0954 |

TABLE 25

Seizure load for the second gear oil with different weight % of the CNTs

| CNT Type | Weight % of CNTs | Seizure Load (kgf) |
|---|---|---|
| None | 0 | 140 |
| Pristine | 0.05 | 130 |
| Pristine | 0.1 | 120 |
| Pristine | 0.2 | 110 |
| Surface Modified | 0.05 | 150 |
| Surface Modified | 0.1 | 140 |
| Surface Modified | 0.2 | 120 |

Figure 8A:
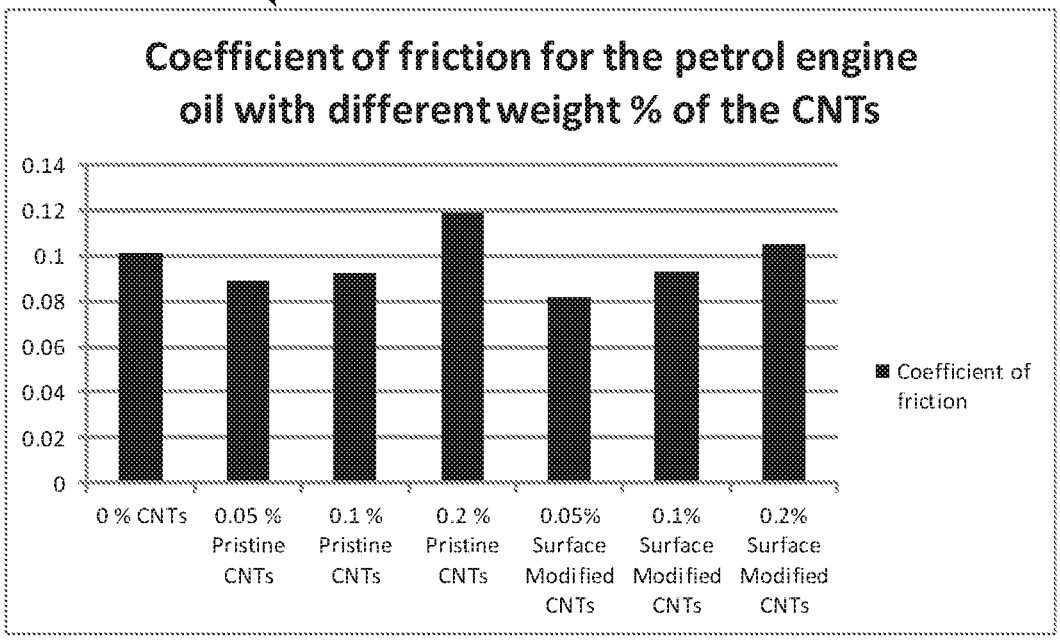
FIG. 8(*a*) illustrates a graph showing coefficient of friction for petrol engine oil with different weight % of the CNTs, in accordance with an implementation of the present subject matter.
Figure 8B:
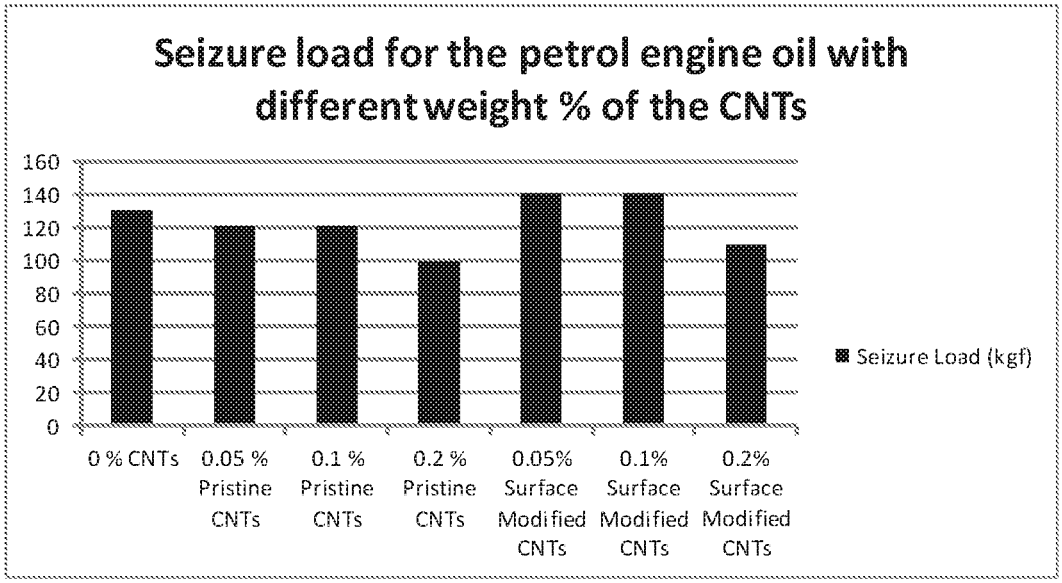
Figure 9A:
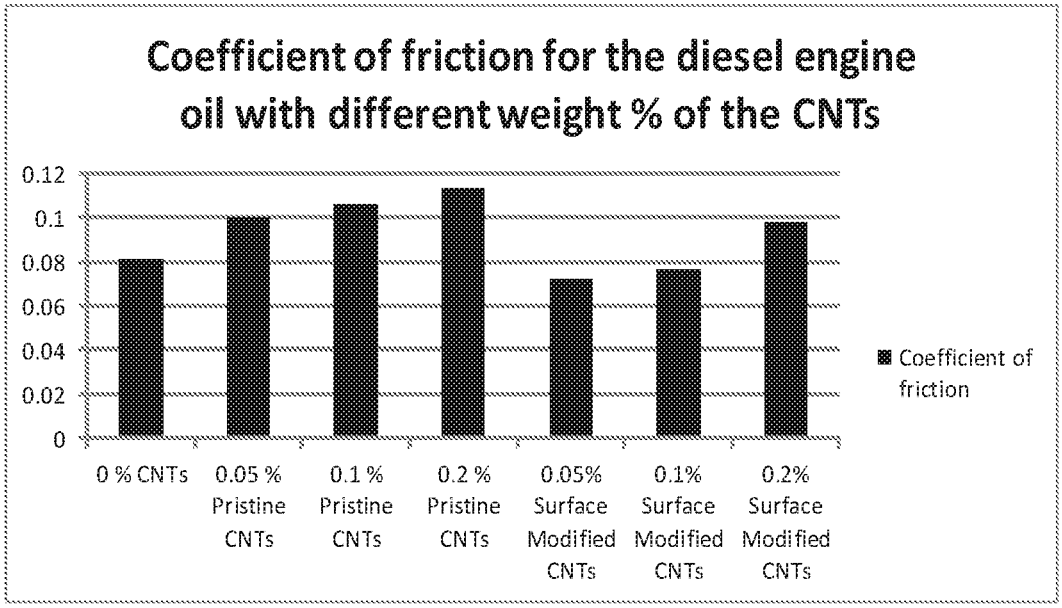
FIG. 9(*a*) illustrates a graph showing coefficient of friction for diesel engine oil with different weight % of the CNTs, in accordance with an implementation of the present subject matter.
Figure 9B:
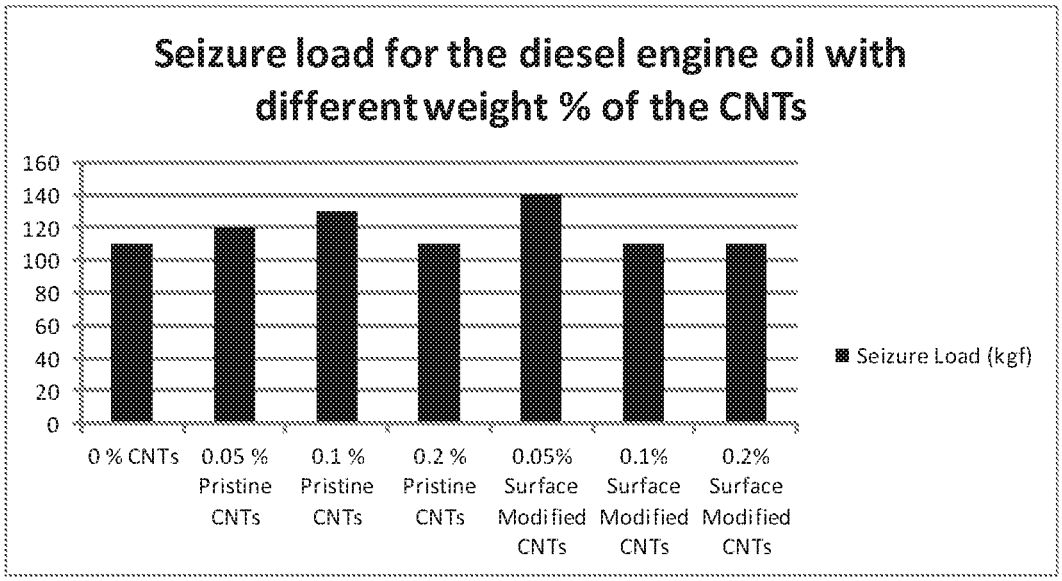
Figure 10A:
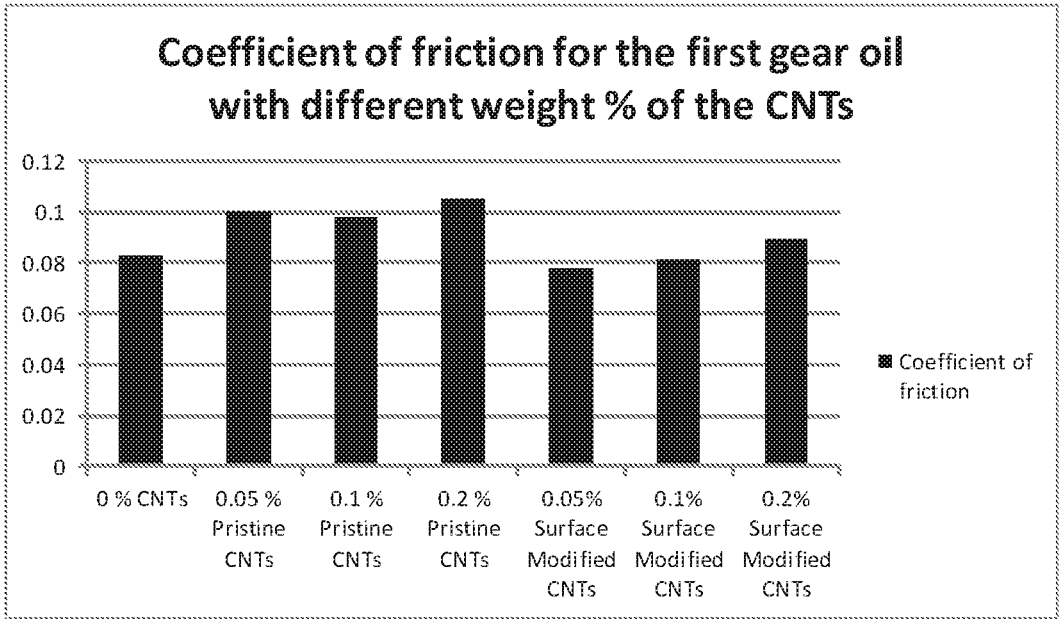
FIG. 10(*a*) illustrates a graph showing coefficient of friction for first gear oil with different weight % of the CNTs, in accordance with an implementation of the present subject matter.
Figure 10B:
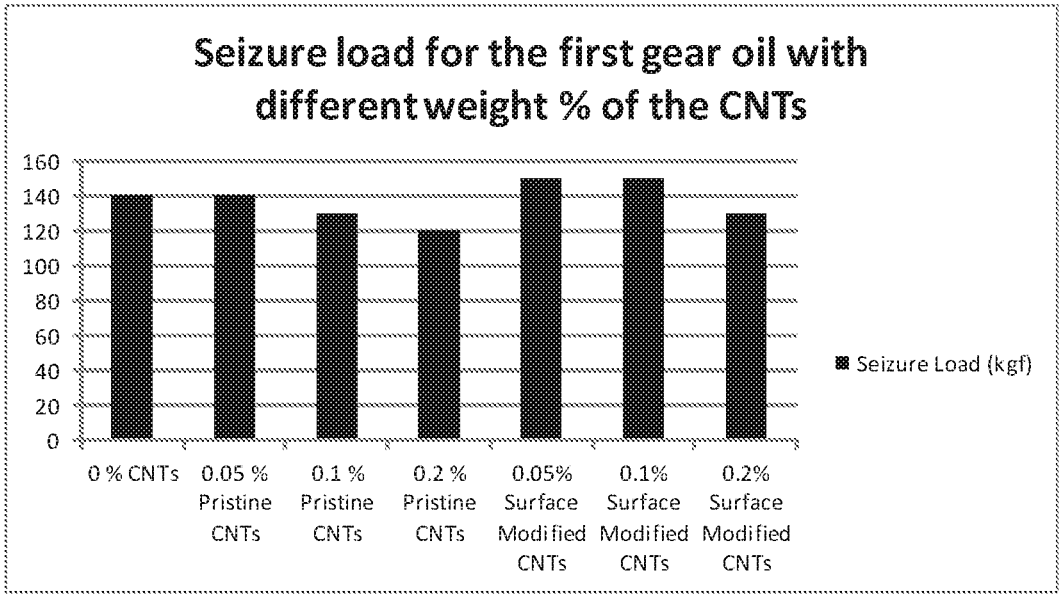
Figure 11A:
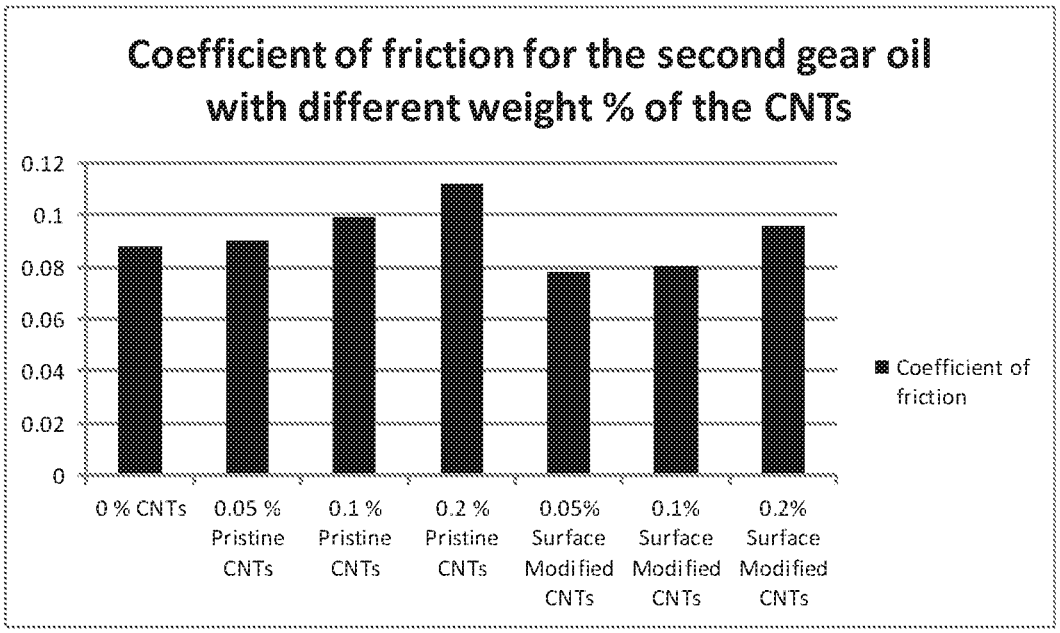
FIG. 11(*a*) illustrates a graph showing coefficient of friction for second gear oil with different weight % of the CNTs, in accordance with an implementation of the present subject matter.
Figure 11B:
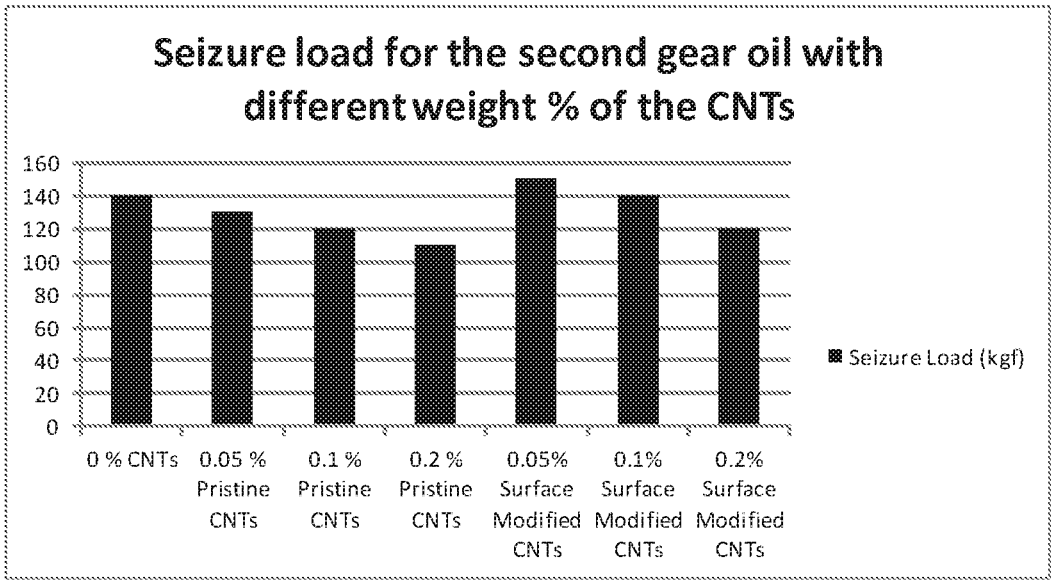

As shown in tables 18-25 and FIGS. 8(*a*), 8(*b*), 9(*a*), 9(*b*), 10(*a*), 10(*b*), 11(*a*), and 11(*b*), the petrol engine oil, the diesel engine oil, and the first and the second gear oils show a significant improvement in anti-friction characteristics due to the addition of 0.05 weight % of the surface modified CNTs.

Example 8

Extreme Pressure Test for Gear Oils

In this example, two extreme pressure properties, the load-wear index and the weld point are measured for the first and the second gear oils as per ASTM D 2783. The balls of the four-ball wear test machine were covered with a gear oil and the fourth ball is rotated at a speed of about 1760 rpm. A series of 10 tests of 10 second duration were carried out at increasing loads until welding of the balls occurred. The first test was carried out at an initial load of 80 kgf and the subsequent tests were carried out at consecutively higher loads until the welding occurred. A check run was made at the end of the 10 tests to determine if the welding occurred. If the welding did not occur, the test was repeated at a next higher load until the welding occurred. The tests were conducted for the first gear oil without the CNTs, with 0.05 weight % pristine CNTs, with 0.1 weight % pristine CNTs, with 0.05 weight % surface modified CNTs, and with 0.1 weight % surface modified CNTs. The tests were also conducted for the second gear oil without the CNTs, with 0.05 weight % pristine CNTs, with 0.1 weight % pristine CNTs, with 0.05 weight % surface modified CNTs, and with 0.1 weight % surface modified CNTs. The results of the example are tabulated in tables 26-29 below and graphically illustrated in FIGS. 12(*a*), 12(*b*), 13(*a*), and 13(*b*).

TABLE 26

Load-wear index for the first gear oil with different weight % of the CNTs

| CNT Type | Weight % of CNTs | Load-wear index |
|---|---|---|
| None | 0 | 55.17 |
| Pristine | 0.05 | 63.3 |
| Pristine | 0.1 | 52.23 |
| Surface Modified | 0.05 | 65.81 |
| Surface Modified | 0.1 | 63.47 |

TABLE 27

Weld point for the first gear oil with different weight % of the CNTs

| CNT Type | Weight % of CNTs | Weld point (kgf) |
|---|---|---|
| None | 0 | 250 |
| Pristine | 0.05 | 315 |
| Pristine | 0.1 | 250 |
| Surface Modified | 0.05 | 315 |
| Surface Modified | 0.1 | 315 |

TABLE 28

Load-wear index for the second gear oil with different weight % of the CNTs

| CNT Type | Weight % of CNTs | Load-wear index |
|---|---|---|
| None | 0 | 65.19 |
| Pristine | 0.05 | 69.67 |
| Pristine | 0.1 | 67.83 |
| Surface Modified | 0.05 | 75.75 |
| Surface Modified | 0.1 | 72.83 |

TABLE 29

Weld point for the second gear oil with different weight % of the CNTs

| CNT Type | Weight % of CNTs | Weld point (kgf) |
|---|---|---|
| None | 0 | 250 |
| Pristine | 0.05 | 315 |
| Pristine | 0.1 | 250 |
| Surface Modified | 0.05 | 400 |
| Surface Modified | 0.1 | 315 |

Figure 12A:
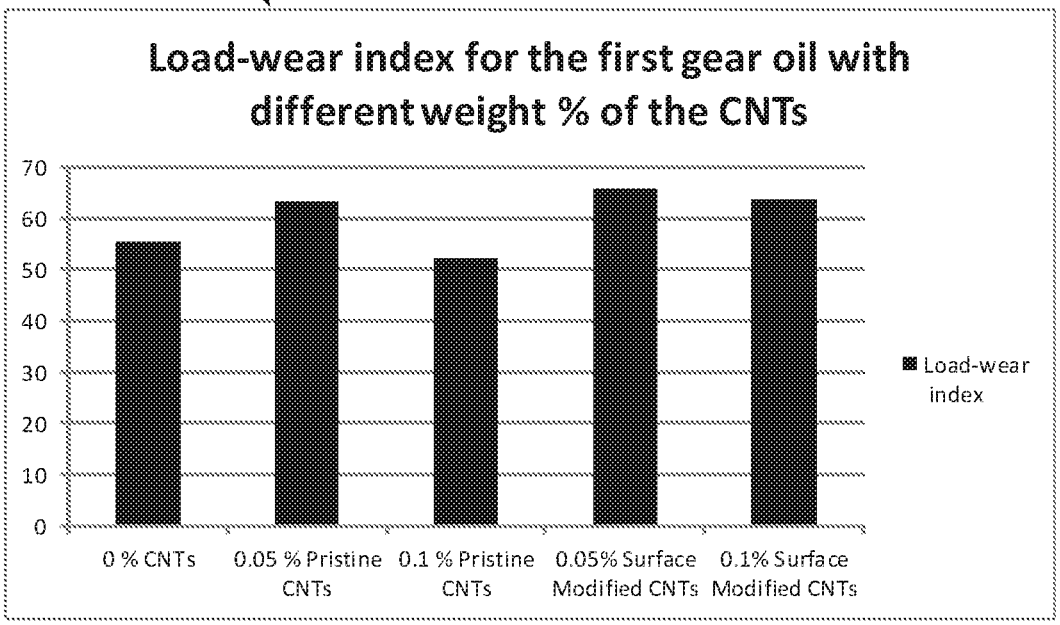
FIG. 12(*a*) illustrates a graph showing load-wear index for first gear oil with different weight % of the CNTs, in accordance with an implementation of the present subject matter.
Figure 12B:
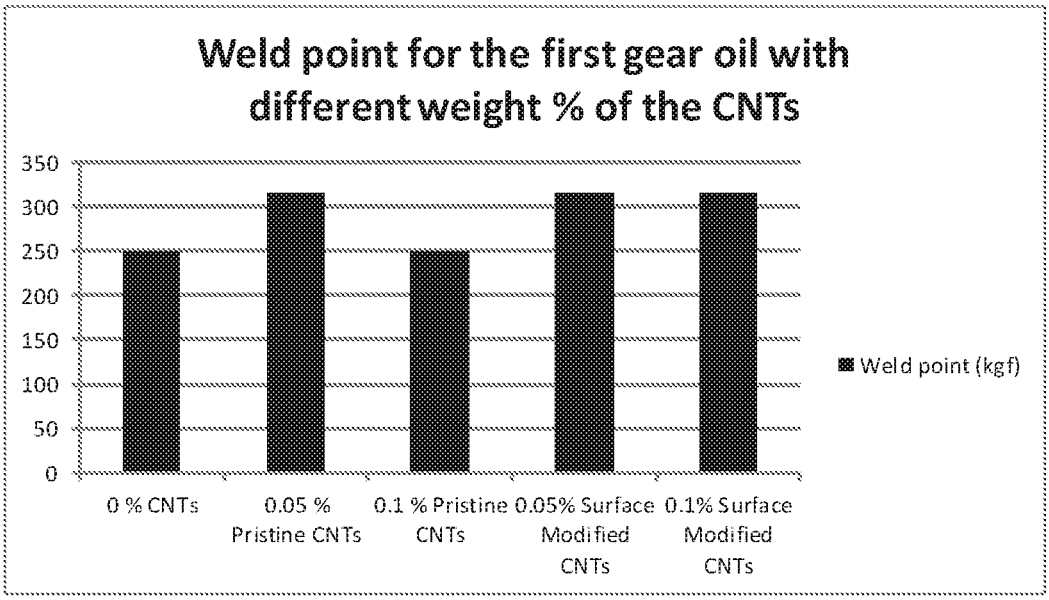
Figure 13A:
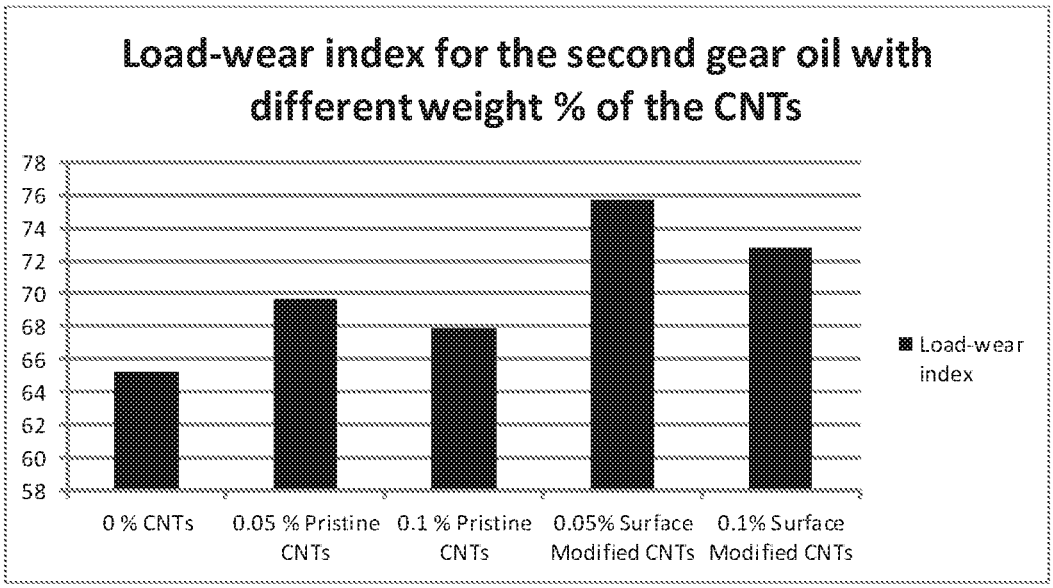
FIG. 13(*a*) illustrates a graph showing load-wear index for second gear oil with different weight % of the CNTs, in accordance with an implementation of the present subject matter.
Figure 13B:
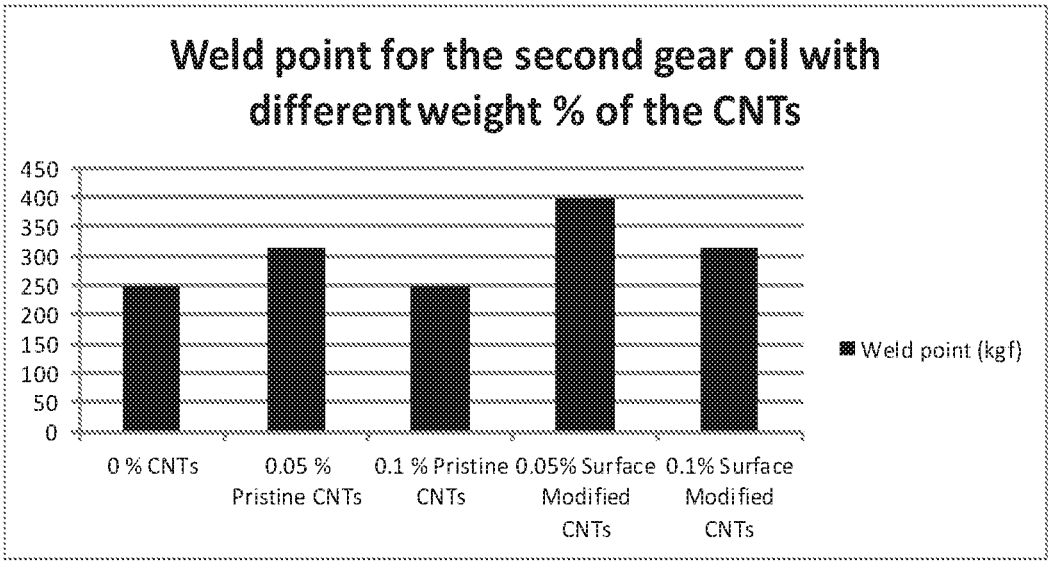

As shown in tables 26-29 and FIGS. 12(*a*), 12(*b*), 13(*a*), and 13(*b*), the first and the second gear oils show a significant improvement in extreme pressure characteristics due to the addition of 0.05 weight % of the surface modified CNTs.

Example 9

Bench Test for Petrol Engine

In this example, brake thermal efficiency, a performance characteristic, of a petrol engine with the petrol engine oil was measured using a petrol engine test rig. The petrol engine test rig comprises an 800 cc, 3 cylinder, 4 stroke multi point fuel injection (MPFI) petrol engine which is connected to an eddy current dynamometer. The petrol engine has a maximum power of 27.2 kW at 5000 rpm and maximum torque of 59 Nm at 2500 RPM. Morse test was carried out for the petrol engine at a speed of 2500 RPM with petrol engine oil without the CNTs, with 0.05 weight % surface modified CNTs, and with 0.1 weight % surface modified CNTs. Morse test was also carried out for the petrol engine at a speed of 4000 RPM with petrol engine oil without the CNTs, with 0.05 weight % surface modified CNTs, and with 0.1 weight % surface modified CNTs. The results of the example are graphically illustrated in FIGS. 14(*a*) and 14(*b*).

Figure 14A:
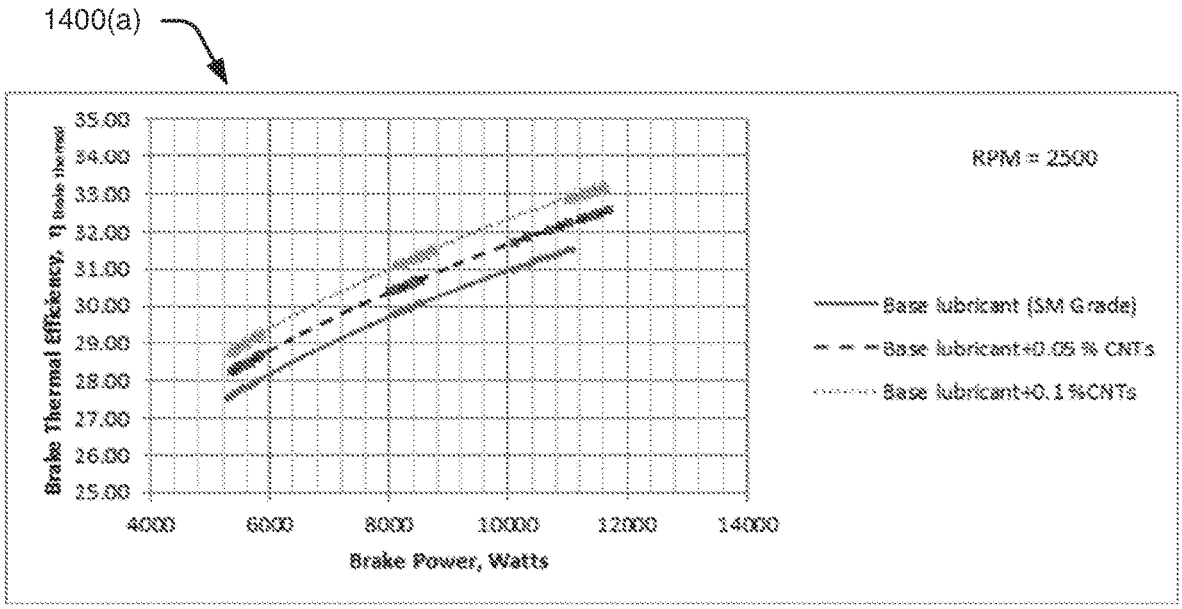
FIG. 14(*a*) illustrates a graph showing brake thermal efficiency at 2500 RPM for petrol engine having petrol engine oil with different weight % of the surface modified CNTs, in accordance with an implementation of the present subject matter.
Figure 14B:
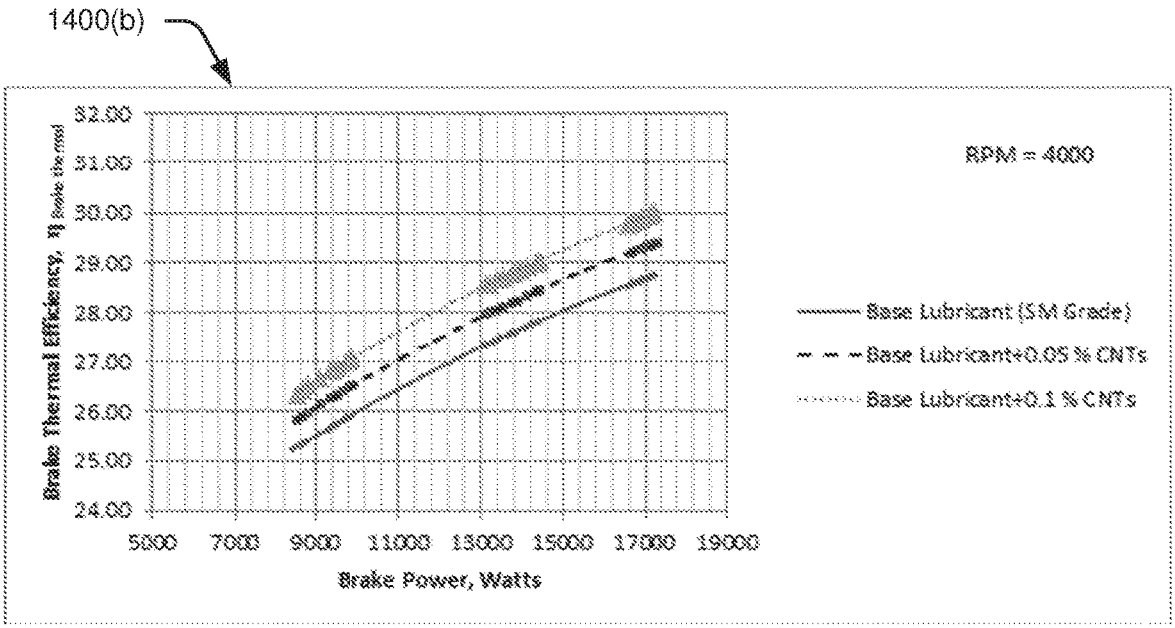

As shown in FIGS. 14(*a*) and 14(*b*), the petrol engine with the petrol engine oil having the surface modified CNTs shows a significant improvement in brake thermal efficiency.

Example 10

Bench Test for Diesel Engine

In this example, brake thermal efficiency of a diesel engine with the diesel engine oil was measured using a diesel engine test rig. The diesel engine test rig comprises 1200 cc four cylinder, four stroke, turbocharged common rail direct fuel injection (CRDI) diesel engine which is connected to an eddy current dynamometer. The diesel engine has a microprocessor based engine management system for ignition, a displacement of 1250 cc, maximum power of 55 kW at 4000 rpm, and maximum torque of 190 Nm at 2500 rpm. Morse test was carried out for the diesel engine at a speed of 2500 rpm with diesel engine oil without the CNTs, with 0.05 weight % surface modified CNTs, and with 0.1 weight % surface modified CNTs. Morse test was also carried out for the diesel engine at a speed of 4000 rpm with diesel engine oil without the CNTs, with 0.05 weight % surface modified CNTs, and with 0.1 weight % surface modified CNTs. The results of the example are graphically illustrated in FIGS. 15(*a*) and 15(*b*).

Figure 15A:
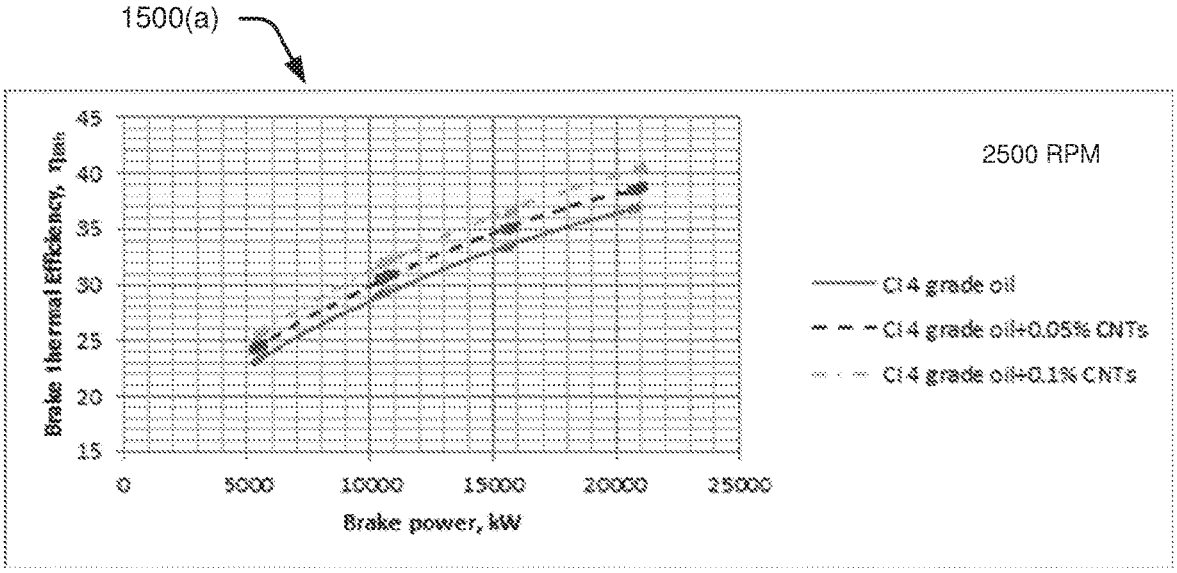
FIG. 15(*a*) illustrates a graph showing brake thermal efficiency at 2500 RPM for diesel engine having diesel engine oil with different weight % of the surface modified CNTs, in accordance with an implementation of the present subject matter.
Figure 15B:
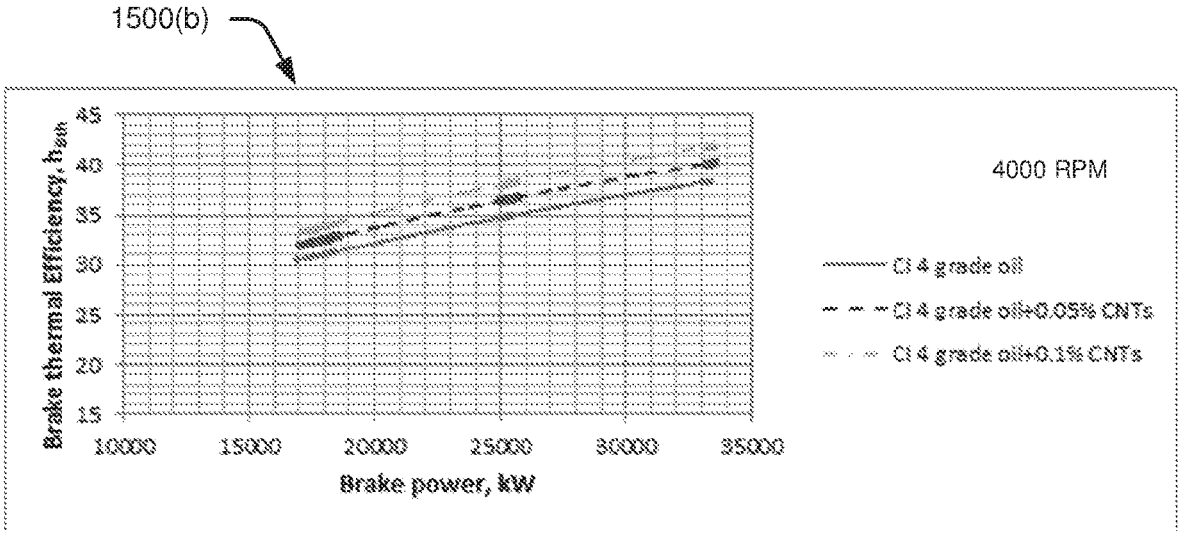

As shown in FIGS. 15(*a*) and 15(*b*), the diesel engine with the diesel engine oil having the surface modified CNTs shows a significant improvement in brake thermal efficiency.

Example 11

Endurance Test for Petrol Engine

In this example, wear performance of the petrol engine oil for a prolonged period of time was measured. The wear performance test of the petrol engine oil was carried out by subjecting the petrol engine with the petrol engine oil to 80 hour test under cyclic loading on a test rig. The test rig comprises a 100 cc single cylinder petrol engine which is connected to an alternating current dynamometer. The specifications of the petrol engine are tabulated in table 30.

TABLE 30

Specifications of petrol engine of test rig for endurance testing of the petrol engine oil

| | |
|---|---|
| Type | Single Cylinder, 4 stroke, Twin spark |
| Displacement | 100 cc |
| Bore × stroke | 50 mm × 49.5 mm |
| Compression Ratio | 8.8:1 |
| Maximum Power | 7.8 bhp @ 7500 rpm |
| Maximum Torque | 8 Nm @ 4500 rpm |
| Ignition System | Digital Electronic Ignition |
| Engine Start | Electric/Kick |
| Maximum Speed | 7500 RPM |

The cyclic loading was conducted for 16 cycles each of 5 hours duration. The test conditions for a 5 hour cycle are tabulated in table 31.

TABLE 31

Test conditions for cyclic loading of petrol engine

| Test duration | Test Conditions |
|---|---|
| 0-2 hours | 75% of full load at maximum speed |
| 2-4 hours | 100% load at speed to maximum torque |
| 4 hours-4 hours and10 minutes | Idling |
| 4 hours and 10 minutes-5 hours | 100% load at maximum speed. |

After completion of the test, the petrol engine was dismantled and the cylinder liner was inspected for possible wear. The wear of the cylinder liner was reported in terms of increase in diameter of the cylinder liner. The diameter of the cylinder liner before and after the test was noted down and the difference was reported as wear of the cylinder liner. The wear of the cylinder liner for the petrol engine oil without the surface modified CNTs and with 0.1 weight % surface modified CNTs are tabulated in table 32.

TABLE 32

Wear of cylinder liner with different petrol engine oils at different positions from the TDC of the engine

| Position from TDC (cm) | Wear for petrol engine oil without surface modified CNTs (μm) | Wear for petrol engine oil with 0.1 weight % surface modified CNTs (μm) |
|---|---|---|
| 2 | 5.0 | 5.0 |
| 4 | 6.5 | 4.25 |
| 4 | 7.5 | 5.13 |
| 8 | 7.55 | 4.50 |

After the completion of the test, the wear of the oil piston rings and the gudgeon pin was reported in terms of weight loss of the piston rings. The weight loss of the piston rings and the gudgeon pin are tabulated in table 33.

TABLE 33

Weight loss of oil piston rings with different petrol engine oils

| Piston rings. | Weight loss for petrol engine oil without surface modified CNTs (μm) | Weight loss for petrol engine oil with 0.1 weight % surface modified CNTs (μm) |
|---|---|---|
| Top compression ring | 2 | 1 |
| Second Compression ring | 18 | 13 |
| Expander | 2 | 2 |
| Oil ring 1 | 7 | 4 |
| Oil ring 2 | 5 | 3 |
| Gudgeon pin | 11 | 8 |

As shown in tables 32 and 33, the petrol engine with the petrol engine oil having the surface modified CNTs shows a significant improvement in anti-wear characteristics.

Example 12

Fuel Consumption Test for the Petrol Engine

In this example, fuel consumption of the petrol engine with the petrol engine oil was measured for the entire duration of the endurance test. The fuel consumption of the petrol engine having petrol engine oil without surface modified CNTs and petrol engine oil with 0.1 weight % surface modified CNTs are tabulated in table 34.

TABLE 34

Fuel consumption for petrol engines with petrol engine oils having different weight % of CNTs

| Weight % of surface modified CNTs in the petrol engine oil | Total fuel consumed (litre) |
|---|---|
| 0 | 93.300 |
| 0.1% | 86.840 |

The instant fuel consumption of the petrol engine having petrol engine oil without surface modified CNTs and petrol engine oil with 0.1 weight % surface modified CNTs were also measured at every 2 hour intervals. The results of the instant fuel consumption are graphically illustrated in FIG. 16.

Figure 16:
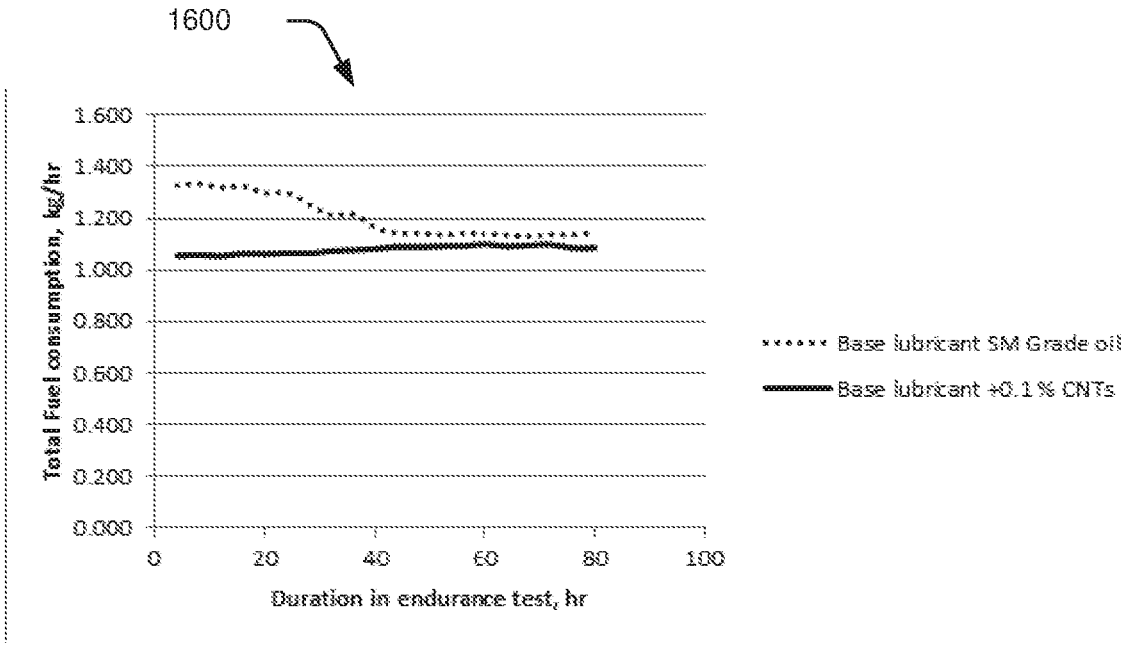
FIG. 16 illustrates a graph showing fuel consumption for petrol engines with petrol engine oils having different weight % of CNTs at different instances, in accordance with an implementation of the present subject matter.

As shown in table 34 and FIG. 16, the petrol engine with the petrol engine oil having the surface modified CNTs shows a significant reduction in fuel consumption compared to the petrol engine oil without the surface modified CNTs.

Example 13

Hydroxyl and Carboxyl Functional Groups in CNTs

In this example, hydroxyl and carboxyl functional groups on the surfaces of the CNTs were analyzed using Fourier transform infrared spectroscope (FTIR). The hydroxyl and carboxyl functional groups on the surfaces of CNTs oxidized using a nitric acid-sulphuric acid solution were analyzed. The hydroxyl and carboxyl functional groups on the oxidized surfaces of CNTs with a lipophilic functional group due to addition of stearic acid were also analyzed. The results of the analysis are graphically illustrated in FIGS. 17(*a*) and 17(*b*).

Figure 17A:
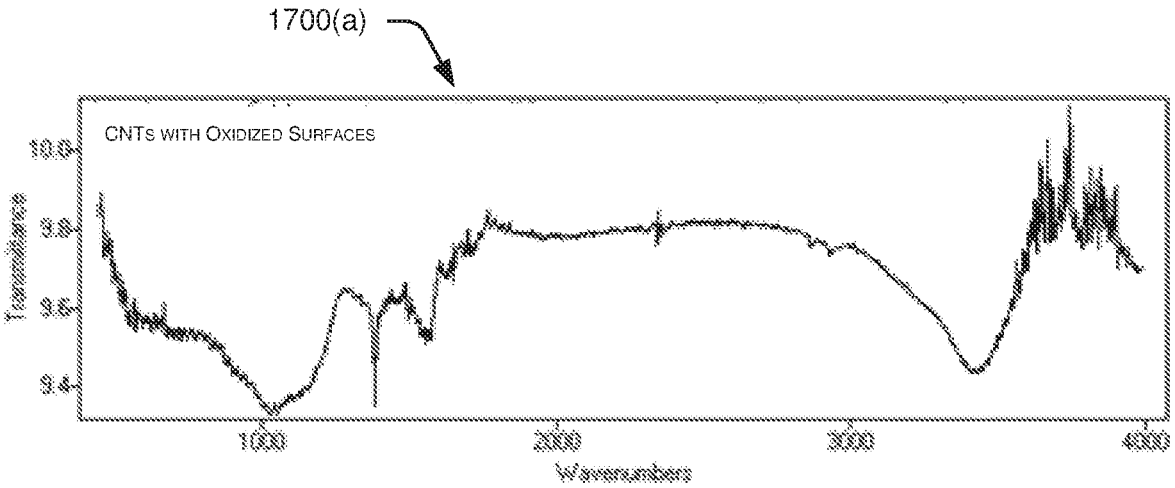
FIG. 17 illustrates a graph showing Fourier transform infrared spectroscope for CNTs for analyzing attached hydroxyl and carboxyl functional groups in the CNTs, in accordance with an implementation of the present subject matter.
Figure 17B:
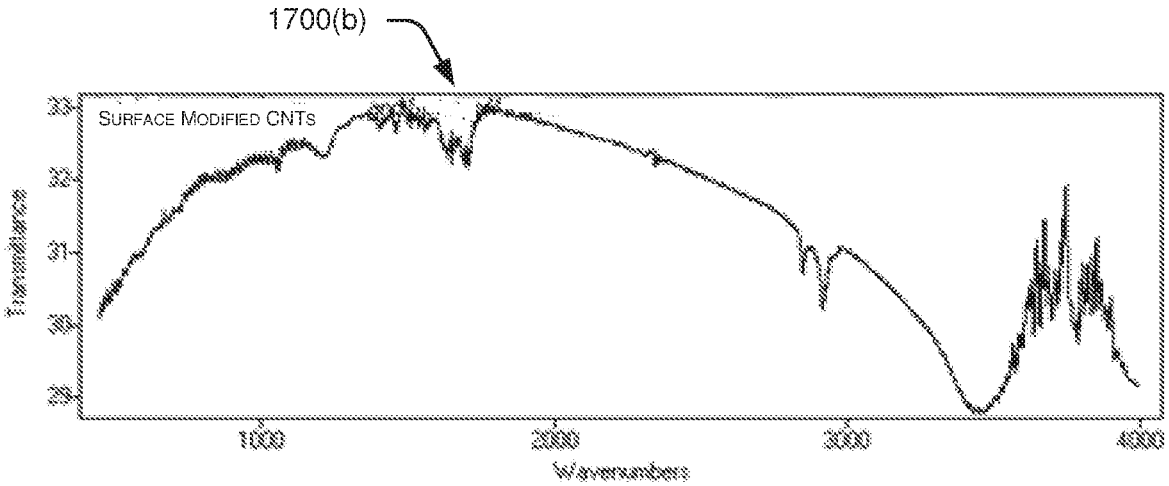

As shown in FIGS. 17(*a*) and 17(*b*), strong peaks of transmittance are formed for the CNTs with the lipophilic functional group on their oxidized surfaces at a wave number range from 1400 $cm^{-1}$ to 1500 $cm^{-1}$ unlike the CNTs with the oxidized surfaces due to the presence of lipophilic functional group on their surfaces.

Example 14

Average Length of CNTs after Ball Milling

In this example, average length of the ball milled CNTs was analyzed using a High resolution Scanning Electron Microscope (HRSEM). The result of the analysis is illustrated in FIG. 18.

Figure 18:
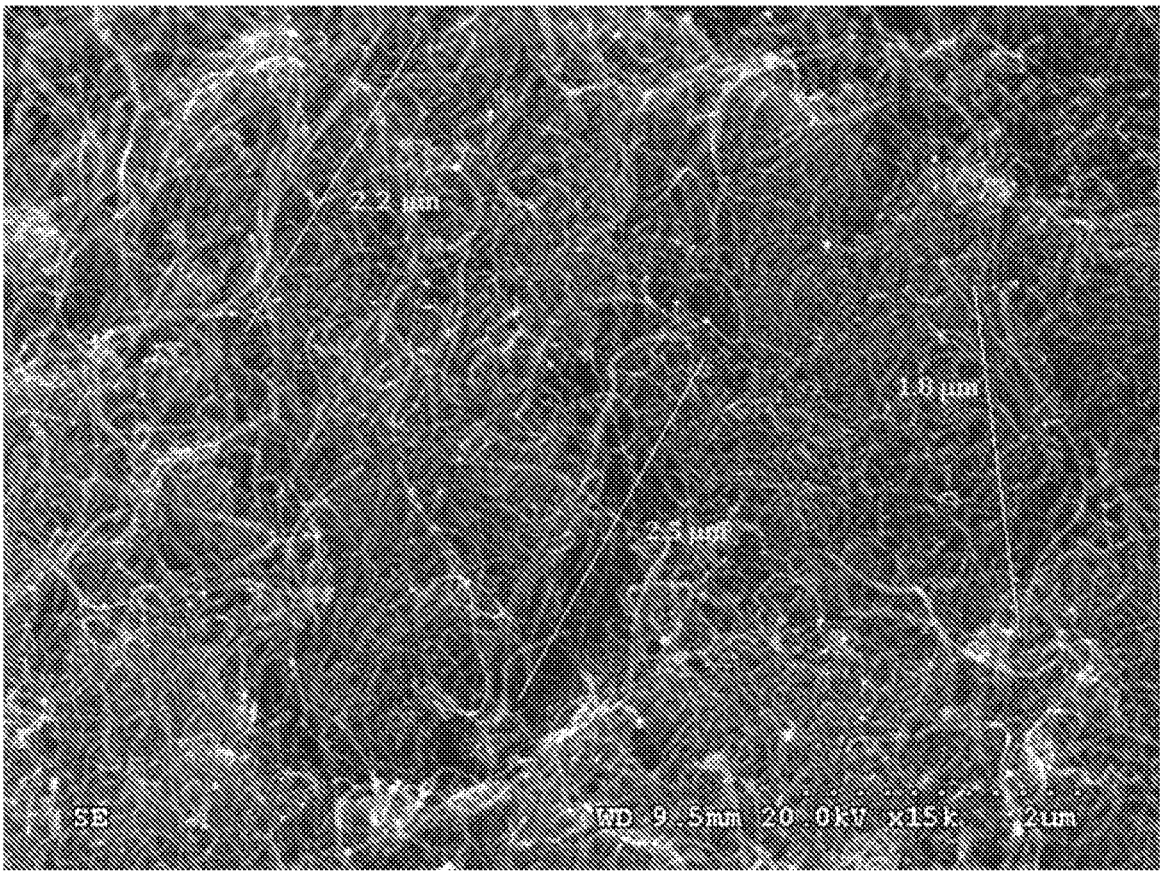
FIG. 18 illustrates analysis of average length of the CNTs using a High resolution Scanning Electron Microscope (HRSEM)

As shown in FIG. 18, the average length of the CNTs is 2 μm to about 3 μm which is the optimum average length.

We claim:

1. A method for preparation of a lubricant dispersed with carbon nanotubes (CNTs), the method comprising:

ball milling the CNTs to obtain CNTs with an optimum average length, wherein the ball milling is performed in a planetary ball mill comprising one or more tungsten carbide coated vials and one or more tungsten carbide coated balls for a time period of about 8 to 16 hours and the optimum average length of the CNTs is about 2 μm to about 3 μm;

purifying the CNTs to remove impurities in the CNTs;

oxidizing surfaces of the purified CNTs by adding the purified CNTs to a solution comprising at least one oxidizing acid and refluxing the solution;

modifying the oxidized surfaces of the CNTs to obtain surface modified CNTs by adding the CNTs to a solution comprising at least one fatty acid; and dispersing the surface modified CNTs in a lubricant to obtain the lubricant dispersed with CNTs, wherein the lubricant comprises about 90 to 99% base oil and about 1 to 10% additives.

2. The method as claimed in claim 1, wherein the purifying of the CNTs comprises:

heating the CNTs in air;

purifying the CNTs using hydrochloric acid solution; and filtering out the CNTs from the hydrochloric acid solution.

3. The method as claimed in claim 2, wherein the heating of the CNTs is performed at a temperature of 600° C. for a time period of about 1 hour.

4. The method as claimed in claim 2, wherein purifying the CNTs using hydrochloric acid solution comprises adding the CNTs to the hydrochloric acid solution and refluxing the hydrochloric acid solution at boil.

5. The method as claimed in claim 2, wherein filtering out the CNTs from the hydrochloric acid solution comprises:

diluting the hydrochloric acid solution with distilled water;

filtering the CNTs from the diluted hydrochloric acid solution;

washing the CNTs with distilled water until the CNTs are at a pH of about 7;

filtering the CNTs using a filter membrane system and a vacuum pump; and drying the CNTs under vacuum.

6. The method as claimed in claim 1, wherein the solution comprising at least one oxidizing acid comprises hydrogen peroxide and sulphuric acid.

7. The method as claimed in claim 1, wherein the solution comprising at least one oxidizing acid comprises sulphuric acid and nitric acid.

8. The method as claimed in claim 1, wherein oxidizing surfaces of the purified CNTs comprises adding about 3 g of the CNTs to about 600 ml of the solution comprising at least one oxidizing acid and refluxing the solution at a temperature of about 120° C.

9. The method as claimed in claim 8 comprising filtering the CNTs from the solution comprising at least one oxidizing acid before modifying the oxidized surfaces of the CNTs.

10. The method as claimed in claim 1, wherein the oxidizing surfaces of the purified CNTs results in attachment of at least one hydrophilic functional group to the surfaces of the CNTs and wherein the at least one hydrophilic functional group is at least one of: a hydroxyl functional group and a carboxyl functional group.

11. The method as claimed in claim 1, wherein the at least one fatty acid comprises at least one of: stearic acid, lauric acid, and oleic acid.

12. The method as claimed in claim 1, wherein the CNTs are added to the solution comprising at least one fatty acid in a 1:4 weight ratio.

13. The method as claimed in claim 1, wherein adding the CNTs to the solution comprising at least one fatty acid comprises:

sonicating a CNT-fatty acid mixture in deionized water to form a suspension;

adding sulphuric acid to the suspension;

refluxing the solution at boil;

cooling the solution at ambient temperature;

filtering the CNTs from the solution;

washing the CNTs with distilled water until the CNTs are at a pH of about 7;

rinsing the CNTs with hexane;

filtering the CNTs; and drying the CNTs.

14. The method as claimed in claim 13, wherein refluxing the solution is performed at a temperature of about 100° C. for a time period in a range from about 2 hours to about 3 hours.

15. The method as claimed in claim 1, wherein dispersing the surface modified CNTs in the lubricant comprises:

adding the surface modified CNTs to the lubricant; and sonicating a mixture of the lubricant and the surface modified CNTs.

16. The method as claimed in claim 15, wherein adding the surface modified CNTs to the lubricant comprises adding the surface modified CNTs to the lubricant in a range of about 0.05 weight % to 0.1 weight %.

17. The method as claimed in claim 15, wherein sonicating the mixture of the lubricant and the surface modified CNTs comprises:

sonicating the mixture of the lubricant and the surface modified CNTs under a pulse mode for a first time period; and sonicating the mixture of the lubricant and the surface modified CNTs under a continuous mode for a second time period.

18. The method as claimed in claim 17, wherein sonicating the mixture of the lubricant and the surface modified CNTs under a pulse mode comprises sonicating, in an ultrasonic probe sonicator, for a time period of about 10 minutes at 50% amplitude for a 0.5 second pulse.

19. The method as claimed in claim 17, wherein sonicating the mixture of the lubricant and the surface modified CNTs under a continuous mode comprises sonicating, in an ultrasonic probe sonicator, for a time period of about 30 minutes at 50% amplitude.

20. The method as claimed in claim 1, wherein the lubricant dispersed with CNTs comprises lubricant dispersed with the surface modified CNTs in an amount from about 0.05 weight % to 0.1 weight %, wherein the surface modified CNTs comprise CNTs having a long chained functional group attached to surfaces of the CNTs.

* * * * *